US005383412A

United States Patent [19]

Sakakibara et al.

[11] Patent Number: 5,383,412

[45] Date of Patent: Jan. 24, 1995

[54] EMBROIDERY SEWING MACHINE

[75] Inventors: Hisato Sakakibara; Kou Shinoda; Yoshihiro Murata, all of Ichinomiya, Japan

[73] Assignee: Kabushikikaisha Barudan, Ichinomiya, Japan

[21] Appl. No.: 28,698

[22] Filed: Mar. 4, 1993

[30] Foreign Application Priority Data

| | | | |
|---|---|---|---|
| Mar. 21, 1992 | [JP] | Japan | 4-94797 |
| Aug. 28, 1992 | [JP] | Japan | 4-253964 |
| Dec. 28, 1992 | [JP] | Japan | 4-359815 |
| Dec. 29, 1992 | [JP] | Japan | 4-360742 |

[51] Int. Cl.[6] ..... D05C 3/02

[52] U.S. Cl. ..... 112/78; 112/217.2; 108/147; 248/132

[58] Field of Search ..... 112/78, 102, 103, 121.11, 112/121.12, 121.15, 217.1, 260, 217.2; 108/144, 147, 148; 248/132, 157, 161, 404, 422

[56] References Cited

U.S. PATENT DOCUMENTS

| | | | |
|---|---|---|---|
| 567,105 | 9/1896 | Linn | 108/147 X |
| 944,560 | 12/1909 | Joseph | 108/147 |
| 1,346,586 | 7/1920 | Barber | 108/147 |
| 2,570,183 | 10/1951 | Weber | 108/147 X |
| 2,738,248 | 3/1956 | Berker . | |
| 3,443,536 | 5/1969 | Rolauffs et al. . | |
| 3,993,008 | 11/1976 | Parsons, Jr. . | |
| 4,018,487 | 4/1977 | Orr et al. . | |
| 4,089,573 | 5/1978 | Aeschliman . | |
| 4,135,463 | 1/1979 | Lacasse . | |
| 4,157,851 | 6/1979 | Tomuro . | |
| 4,201,427 | 5/1980 | Orr . | |
| 4,202,284 | 5/1980 | Parsons et al. . | |
| 4,367,687 | 1/1983 | Sanvito | 112/217.1 |
| 4,386,573 | 6/1983 | Davidson et al. . | |
| 4,559,879 | 12/1985 | Hausser . | |
| 4,690,466 | 9/1987 | Bakr et al. . | |
| 4,691,888 | 9/1987 | Cotterill . | |
| 4,850,563 | 7/1989 | Grout | 108/147 X |
| 4,993,333 | 2/1991 | Moore, III . | |
| 5,228,401 | 7/1993 | Moore, III | 112/103 |
| 5,249,533 | 10/1993 | Moore . | |
| 5,249,537 | 10/1993 | Sakakibara . | |

FOREIGN PATENT DOCUMENTS

| | | |
|---|---|---|
| 2679267 | 1/1993 | France . |
| 111752 | 4/1989 | Japan . |
| 1373752 | 11/1974 | United Kingdom . |
| 1504318 | 3/1978 | United Kingdom . |
| 1595551 | 8/1981 | United Kingdom . |
| 2077777 | 12/1981 | United Kingdom . |

*Primary Examiner*—Clifford D. Crowder
*Assistant Examiner*—Paul C. Lewis
*Attorney, Agent, or Firm*—Cushman, Darby & Cushman

[57] ABSTRACT

To improve embroidery precision by preventing the front end of an embroidery frame from being pulled down by the weight of cloth workpiece, the embroidery sewing machine comprises: at least one cylindrical bed disposed on the upper portion of a machine frame; a table disposed on the upper portion of the machine frame and divided into a fixed table and an up-and-down table; a mechanism for supporting the up-and-down table vertically movably at an upward position roughly flush with the cylindrical bed and at least two downward positions of different height; and a mechanism for holding the up-and-down table at the upward position and the at least two downward positions, respectively.

26 Claims, 24 Drawing Sheets

FIG. 26 PRIOR ART
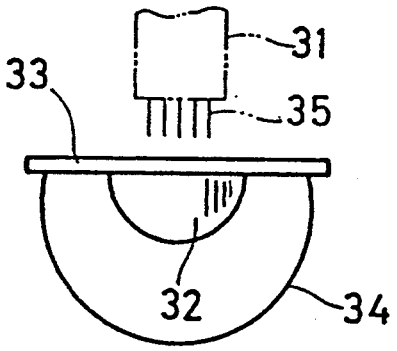
FIG. 27 PRIOR ART
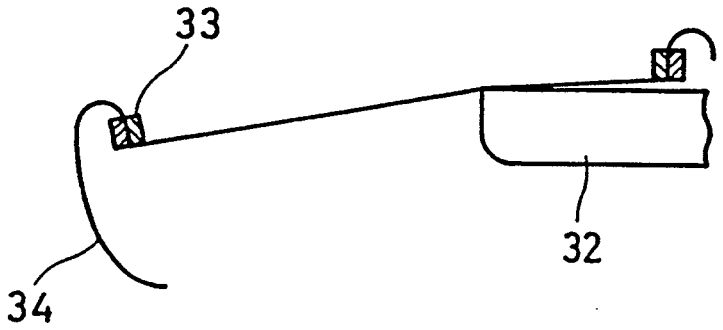

EMBROIDERY SEWING MACHINE

BACKGROUND OF THE INVENTION

1. Field of the Invention

The present invention relates to an embroidery sewing machine, and more specifically to an embroidery sewing machine provided with a cylindrical bed under an embroidery head.

2. Description of the Prior Art

In the conventional embroidery sewing machine used for embroidery processing of finished goods such as T shirts or sweaters, as shown in FIG. 26, a cylindrical bed 32 is disposed under an embroidery head 31 so that an embroidery frame 33 can be moved back and forth and right and left on the cylindrical bed 32. Part of a piece of cloth 34 to be processed (referred to as a cloth workpiece, hereinafter) is stretched in the embroidery frame 33, and a seam is formed in the cloth workpiece 34 through operation of needles 35 attached to the embroidery head 31 and a rotating hook bobbin (not shown) housed within the cylindrical bed 32. The remaining part of the cloth workpiece 34 hangs down from the embroidery frame 33 due to the weight of the cloth workpiece 34. In the prior art embroidery sewing machine, however, there exists no member for supporting the hanging-down portion of the cloth workpiece 34.

Accordingly, in the prior art embroidery sewing machine, as shown in FIG. 27, the embroidery frame 33 is moved under the condition that the front end of the embroidery frame 33 is pulled downward by the weight of the cloth workpiece 34. Therefore, there exists a problem in that the cloth workpiece 34 is slid in tight contact with the front end edge of the cylindrical bed 32 and thereby the cloth workpiece is gradually loosened, thus resulting in a deterioration of embroidery precision.

SUMMARY OF THE INVENTION

The object of the present invention is to provide an embroidery sewing machine, which can improve the embroidery precision by preventing the front end of the embroidery frame from being pulled down by the weight of the cloth workpiece.

To achieve the above-mentioned object, the present invention provides an embroidery sewing machine in which a table and at least one cylindrical bed are disposed on the upper portion of a machine frame; and at least one embroidery frame is moved on the cylindrical bed to form a seam in the cloth workpiece stretched in the embroidery frame, characterized in that the table is divided into a fixed table and a movable up-and-down table. Also provided are means for supporting the up-and-down table in a manner which permits vertical movement between an upward position roughly flush with the cylindrical bed and at least two downward positions of different height under the upward position and means for holding the up-and-down table at the upward position and the at least two downward positions, respectively.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 26 is an illustration for assistance in explaining the problem associated with the prior art embroidery sewing machine; and FIG. 27 is a cross-sectional view showing the prior art embroidery sewing machine shown in FIG. 26.

DETAILED DESCRIPTION OF THE PREFERRED EMBODIMENTS

Figure 1:
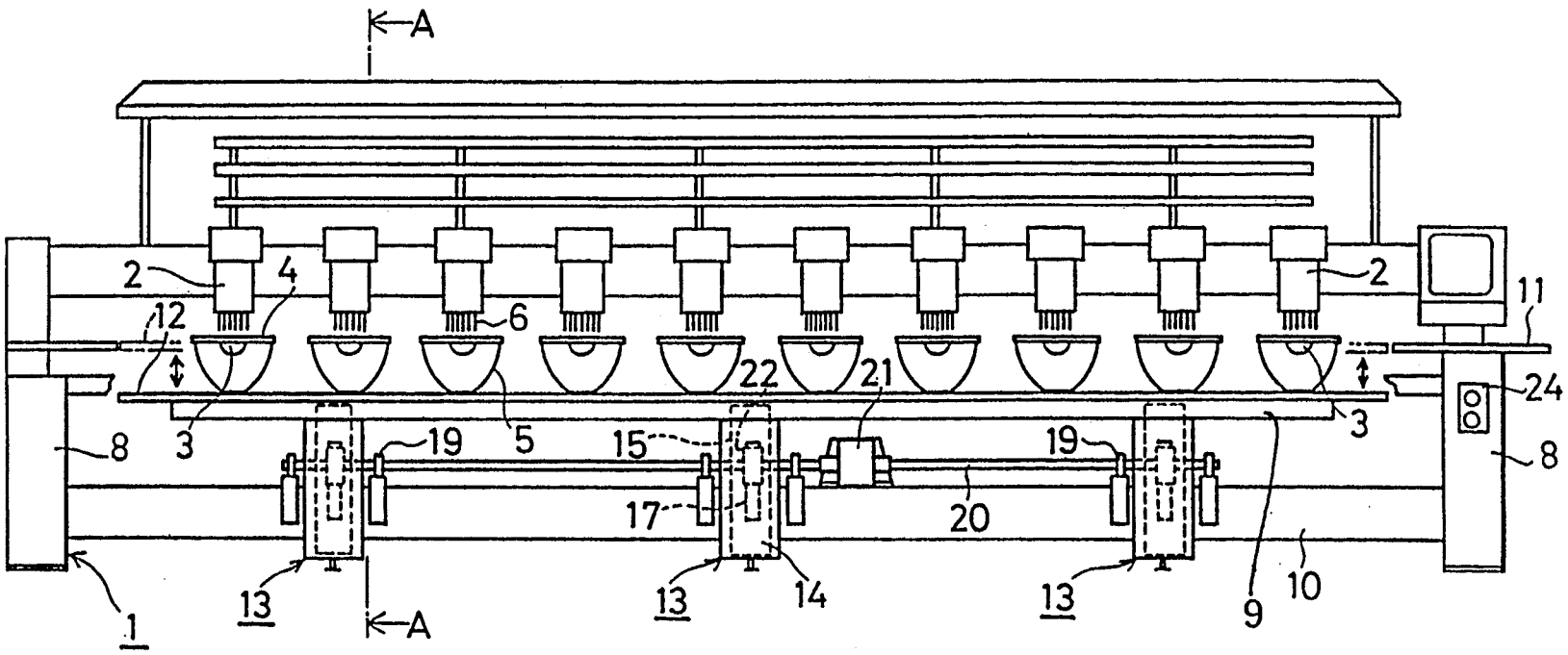
FIG. 1 is a front view showing a first embodiment of the embroidery sewing machine according to the present invention.

The supporting means of the present invention comprises movable legs connected with the up-and-down table and fixed legs connected with the machine frame to guide up-and-down motion of the movable legs respectively, for instance. It is preferable to connect an upper end of each of the movable legs to one of the points where the up-and-down table is supported to be balanced. Further, it is preferable to provide means for driving the up-and-down table vertically up and down. The driving means comprises a rack gear provided for the movable leg, a pinion gear in mesh with the rack gear, and a motor for rotating the pinion gear, for instance. In this case, it is possible to use a brake provided for the motor as the holding means.

It is possible to construct the front end portion of the up-and-down table so as to be folded downward with a hinge attached to the up-and-down table. Further, it is possible to dispose at least one embroidery frame movably on the cylindrical bed, and an attachment movably on the up-and-down table to support the embroidery frame from below.

Further, it is possible to construct the driving means by a rack provided for the movable leg, a pinion in mesh with the rack, a worm wheel rotatable together with the pinion, a worm in mesh with the worm wheel, and a manually operated handle for rotating the worm. In this case, the holding means is provided by the worm not rotated by a rotational force transmitted from the worm wheel side. Further, it is preferable to provide a clamp device for clamping the movable leg to the fixed leg.

Further, it is possible to construct the supporting means by a parallel crank mechanism for moving the up-and-down table in parallel motion. The parallel crank mechanism comprises a coupling member fixed to the up-and-down table, a part of the machine frame, and a pair of crank arms each having one end rotatably connected to the coupling member and the other end rotatably connected to a part of the machine frame.

In the case where the parallel crank mechanism is adopted, it is preferable to provide means for auxiliarily driving the up-and-down table. The auxiliary driving means comprises an elastic member connected to at least one of a pair of the crank arms to apply an upward force to the up-and-down table at all times, for instance. Further, the auxiliary driving means comprises an elastic member connected to at least one of a pair of the crank arms to apply an upward force to the up-and-down table when the up-and-down table is located at an upward position and a downward force to the up-and-down table when the up-and-down table is located at a downward position.

In the case where the parallel crank mechanism is adopted, it is possible to construct the holding means by a first engage member formed with a plurality of engage grooves of different height, and a second engage member provided with an engage projection engageable with and disengageable from one of the engage grooves of the first engage member in such a way that the first and second engage members are provided for the up-and-down table and the machine frame, relatively, for instance. It is possible to provide the first engage member so as to be pivotal and additionally an elastic member for urging the first engage member so that the engage projection is kept engaged with the engage groove. Further, it is possible to enable the second engage member to be pivotal and to additionally provide a lock device for locking pivotal motion of the second engage member so that the engage projection is kept engaged with the engage groove.

Further, it is possible to construct the supporting means by a slide body mounted on a support frame of the up-and-down table, and a rail mounted on the machine frame to guide up-and-down motion of the slide body. In this case, it is preferable to provide means for auxiliarily driving the up-and-down table. The auxiliary driving means may be a cylinder connected to the up-and-down table to apply an upward force to the up-and-down table at all times, for instance. In this case, the holding means comprises a fixing member provided for a support frame of the up-and-down table, and an engage body provided for the machine frame vertically movably so as to be engaged with and disengaged from the fixing member.

When a flat cloth workpiece such as handkerchief is embroidered with the use of the embroidery sewing machine according to the present invention, the up-and-down table is raised to the upward position roughly flush with the cylindrical beds with the supporting means, and held with the holding means at the upward position, for prevention of unexpected dropping down of the up-and-down table. Thereafter, the embroidery frames are moved on the cylindrical beds and seams are formed in the cloth workpiece stretched in the embroidery frames.

Further, when a cylindrical cloth workpiece such as sewed T shirts or sweaters are embroidered, the up-and-down table is lowered to a selected one of the at least two downward positions of different height with the supporting means, and held at the selected downward position with the holding means for prevention of unexpected up-and-down motion of the up-and-down table. Thereafter, the embroidery frames are set on the cylindrical beds, and the hanging down ends of the cloth workpieces are received on the upper surface of the up-and-down table, by placing the cylindrical bed inside the cylindrical cloth workpiece hanging down from the embroidery frame.

Although the height of the hanging down end of the cloth workpiece is different according to the kind or size of the cloth workpieces, since the up-and-down table can be lowered and held at any one position selected from the at least two downward positions of different height, it is possible to receive the hanging down end of any type of cloth workpieces, that is, to support a part of the weight of the cloth workpiece. As a result, the force which pulls down the embroidery frame can be reduced, so that it is possible to prevent the embroidery frame from being pulled downward. Accordingly, when seams are formed in the cloth workpiece by moving the embroidery frames on the cylindrical beds, it is possible to prevent the cloth workpiece from sliding into tight contact with the front end of the cylindrical bed, thus to allow the cloth workpiece to be held at a regular position relative to the embroider frame for providing a precise seam formation.

A first embodiment of the present invention will be described hereinbelow with reference to FIGS. 1 to 3. As shown in FIG. 1, in the embroidery sewing machine of the first embodiment, a plurality of embroidery heads 2 are arranged in a row on the upper portion of a machine frame 1, and a plurality of cylindrical beds 3 are provided under the respective embroidery heads 2 so as to project in the frontward direction. An embroidery frame 4 is mounted on each cylindrical bed 3. The frame 4 is moved back and forth and right and left by a common driving frame (shown in FIG. 24) linked with the rear portions of these frames 4. Further, a part of a cloth workpiece 5 is stretched in the embroidery frame 4 so that a seam can be formed by cooperation of needles 6 and a rotating hook bobbin.

Figure 2:
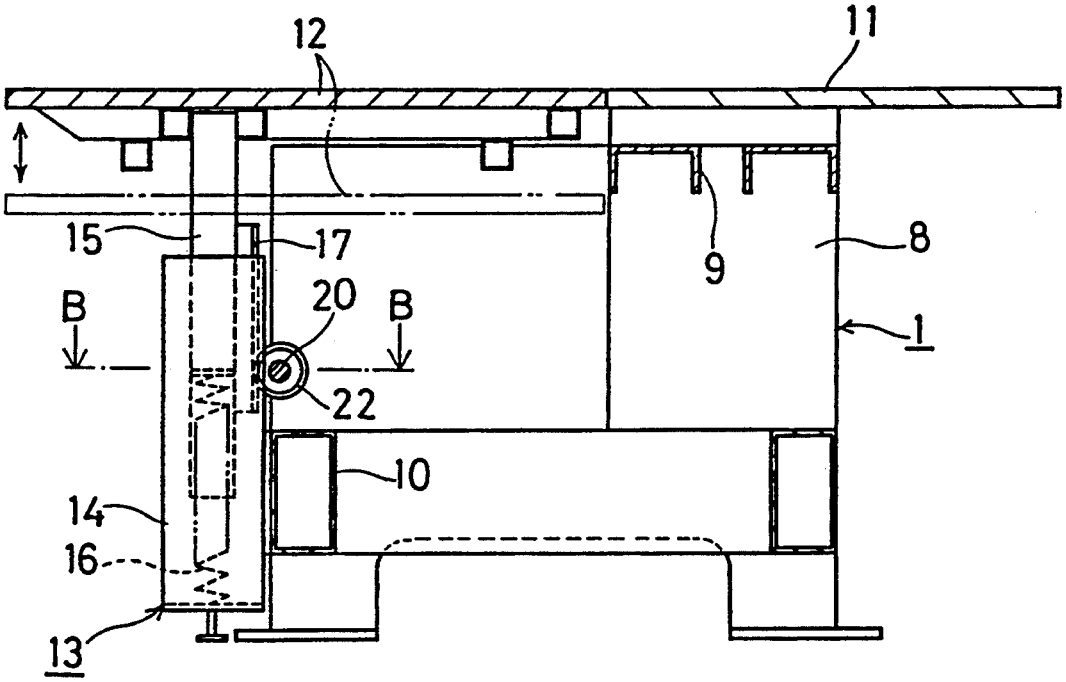
FIG. 2 is a cross-sectional view taken along the line A—A shown in FIG. 1.

As shown in FIGS. 1 and 2, the machine frame 1 is constructed by linking both right and left side walls 8 with an upper beam 9 and a lower beam 10. A U-shaped (when seen from above) fixed table 11 is fixed on the upper surfaces of the right and left side and the rear side of the machine frame 1. Within the fixed table 11, an up-and-down table 12 is disposed to receive the cloth workpieces 5 hanging down from the respective embroidery frames 4 under the respective embroidery heads 2. The up-and-down table 12 is vertically movably supported by three supporting legs (supporting means) 13. The up-and-down table 12 is formed with a plurality of cutout portions (not shown) in which the cylindrical heads 3 are located when the up-and-down table 12 is moved at its upward position.

Each supporting leg 13 is composed of a fixed leg 14 fixed to the lower beam 10, a movable leg 15 inserted into the fixed leg 14, and a spring 16 for urging the movable leg 15 within the fixed leg 14 in the upward direction so as to be freely expandable and contractible. The upper end of the middle movable leg 15 is connected to roughly a center of gravity of the up-and-down table 12, of each of the right and left movable legs 15 is connected to one of the two points around roughly the center of gravity of the up-and-down table 12. A and rack 17 is formed on the outer surface of the movable leg 15. The spring 16 is provided with such functions as to assist a driving force of a motor (described later), to move the movable leg 15 up and down smoothly, and to damp the shock caused when the movable leg 15 is moved in the downward direction. These functions are all effective even if the motor is replaced with a hand handle rotated manually.

Figure 3:
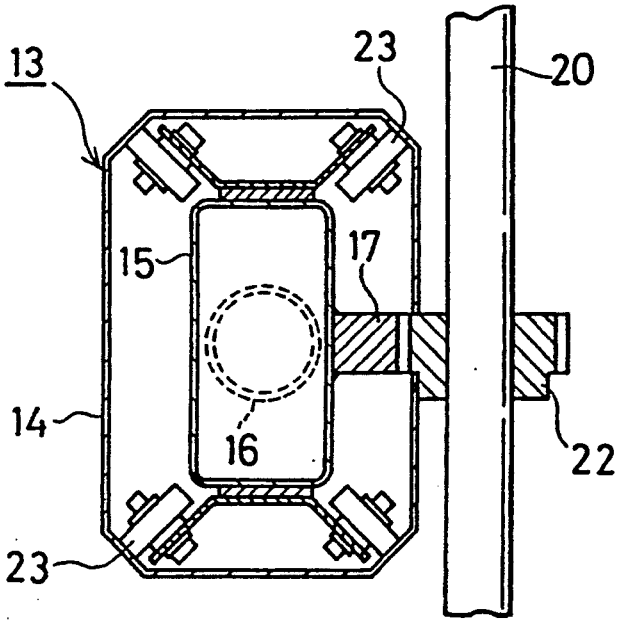
FIG. 3 is a cross-sectional view taken along the line B—B shown in FIG. 2.

As shown in FIGS. 1 and 3, a shaft 20 is supported to the lower beam 10 by a plurality of bearings 19. Further, a motor (driving means) 21 for driving this shaft 20 is also mounted on the lower beam 10. The motor 21 is provided with a brake (holding means)(not shown). A plurality of pinions 22 are fixed to the shaft 20 so as to mesh with the racks 17 of the support legs 13, respectively. Therefore, when the motor 21 is rotated in the forward or reverse direction, the up-and-down table 12 is moved up and down via the movable legs 15. After the motor 21 has been stopped, the up-and-down table 12 is held at the upward position and at any desired downward position thereof by the brake. Further, as shown in FIG. 3, the movable leg 15 is provided with a plurality of rollers 23 in contact with the four inner corner surfaces of the fixed leg 14, so as to be guided smoothly up and down under the condition that the movable leg 15 is located within the fixed leg 14. In FIG. 1, a switch 24 is provided to control the motor 21 so as to be driven in the forward and reverse directions or stopped. By depressing this switch 24, the up-and-down table 12 can be inched for vertical location.

When finished goods such as T shirts or sweaters are embroidered with the use of the embroidery sewing machine constructed as described above, the up-and-down table 12 is located by the motor 21 at the downward position (the solid line position in FIG. 1 and the dot-dot-dashed line position in FIG. 2) at which the hanging down end portion of the cloth workpiece 5 can be received by the up-and-down table 12. Under these conditions, since part of the weight of the cloth workpiece 5 is supported by the up-and-down table 12, a downward force applied to the embroidery frame 4 can be reduced, so that it is possible to securely prevent the embroidery frame 4 from being pulled downward. Accordingly, it is possible to prevent the cloth workpiece 5 from being slid in tight contact with the front end of the cylindrical beds 3, thus to allow the seam to be precisely formed under the condition that the cloth workpiece 5 is held by the embroidery frame 4 at the regular position. In addition, since the up-and-down table 12 can be moved continuously at any desired downward position by the motor 21 in stepless operation, even if the kind or size of the cloth workpiece 5 differs, it is possible to easily adjust the height of the up-and-down table 12 at any position at which the hanging down portion of the cloth workpiece 5 can be received appropriately according to the cloth workpiece now being processed. Further, since the upper end of the movable leg 15 is connected to one of the points where the up-and-down table 12 is supported to be balanced, there exists such an advantage that the up-and-down table 12 can be moved up and down smoothly without being subjected to distortion.

Further, when a flat cloth workpiece (not shown) such as a handkerchief is embroidered, the up-and-down table 12 is located by the motor 21 at the upward position (the dot-dot-dashed line position in FIG. 1 and the solid line position in FIG. 2), at which the upper surface of the up-and-down table 12 is roughly flush with the upper surfaces of the fixed table 11 and the cylindrical beds 3.

Figure 4:
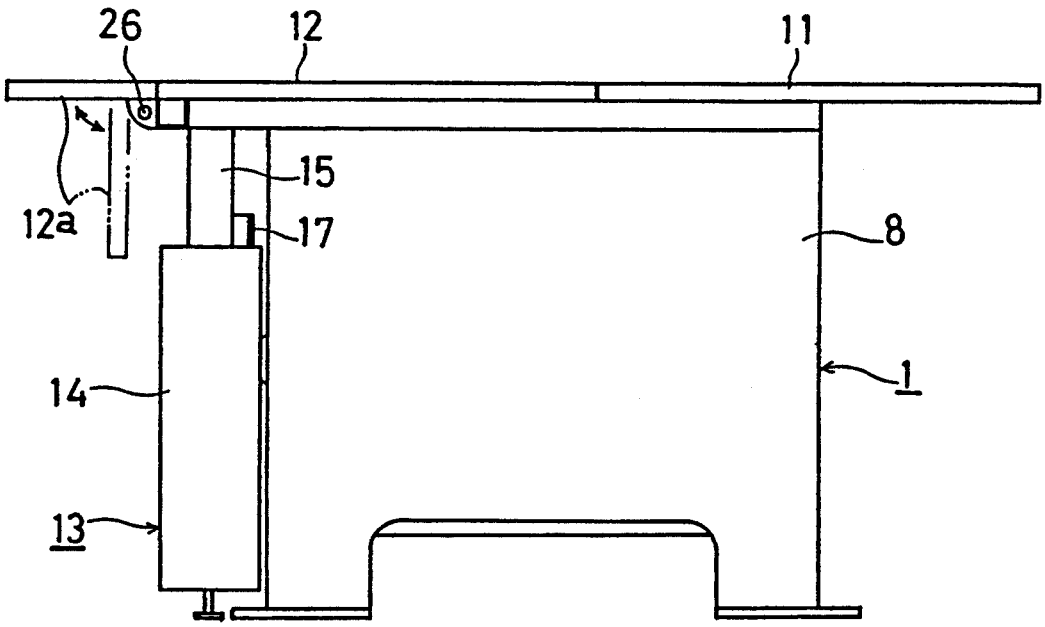
FIG. 4 is a side view showing a second embodiment of the embroidery sewing machine according to the present invention.

A second embodiment of the present invention will be described with reference to FIG. 4. The point different from the first embodiment is that a front end portion **12*a* of the up-and-down table 12 is so constructed as to be folded downward with a hinge 26. In this second embodiment, the cloth workpiece 5 can be received by the up-and-down table 12 including the front end portion 12*a* during the embroidery processing in the same way as in the first embodiment. In addition, after embroidery processing, the front end portion 12*a* of the up-and-down table 12 is folded down to reduce the length of the up-and-down table 12**, so that it is possible to allow the various works such as thread exchange or inspection or maintenance to be more easily conducted.

Figure 5:
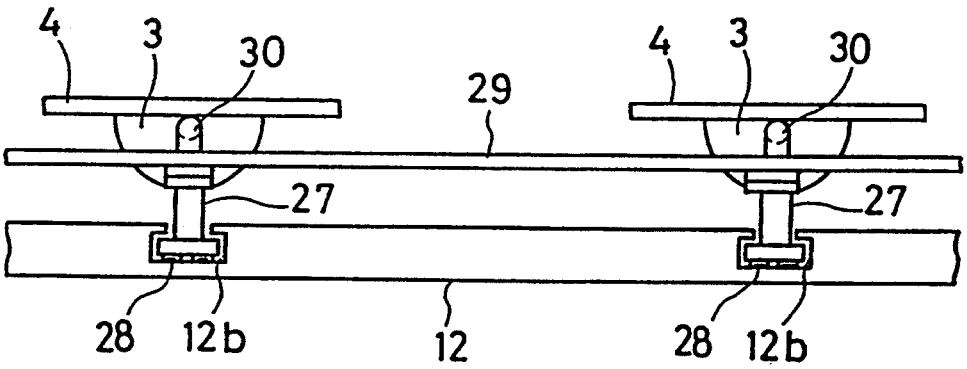
FIG. 5 is a front view showing a table of in a third embodiment of the embroidery sewing machine according to the present invention.
Figure 6:
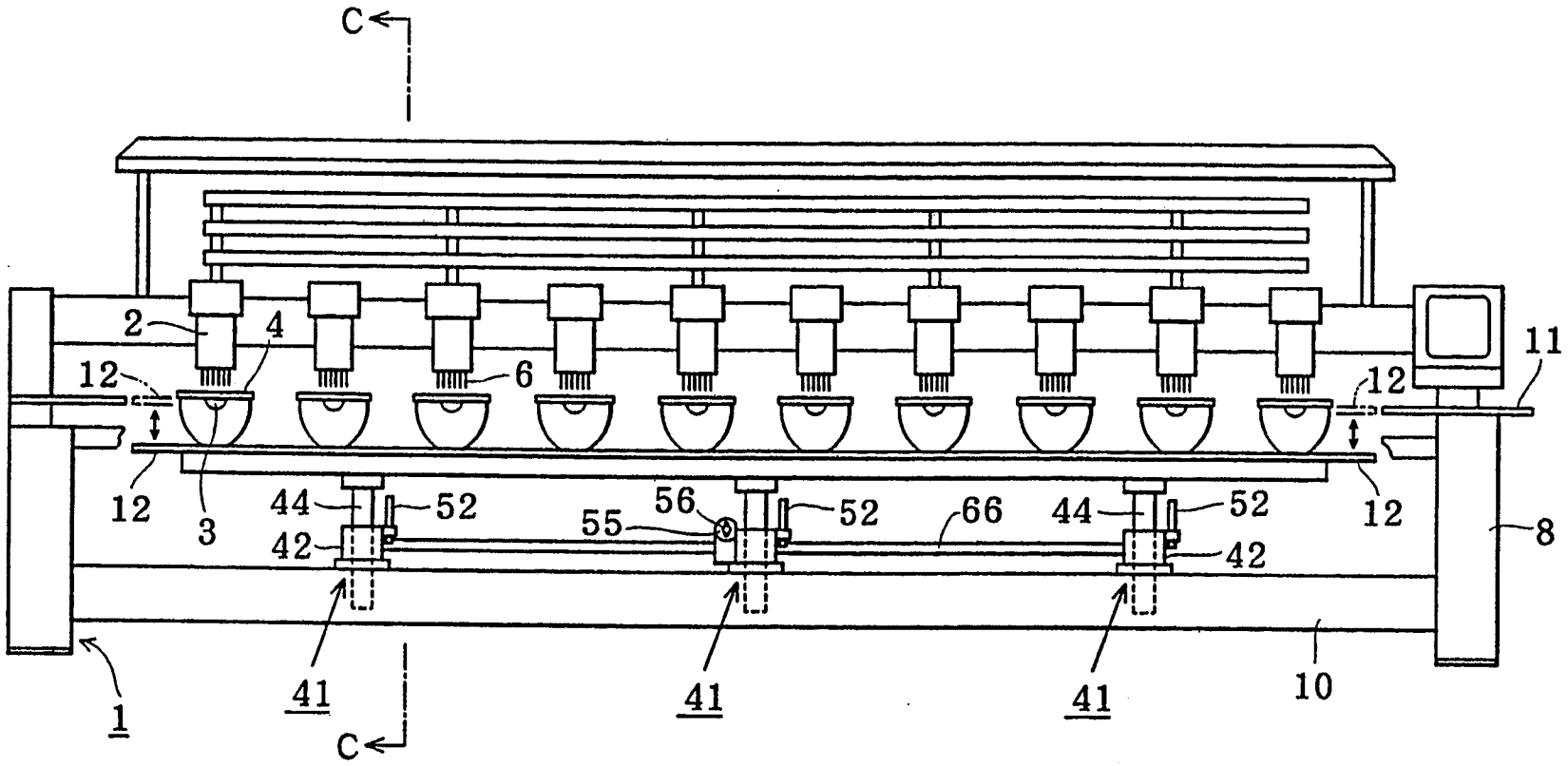
FIG. 6 is a front view showing a fourth embodiment of the embroidery sewing machine according to the present invention.
Figure 7:
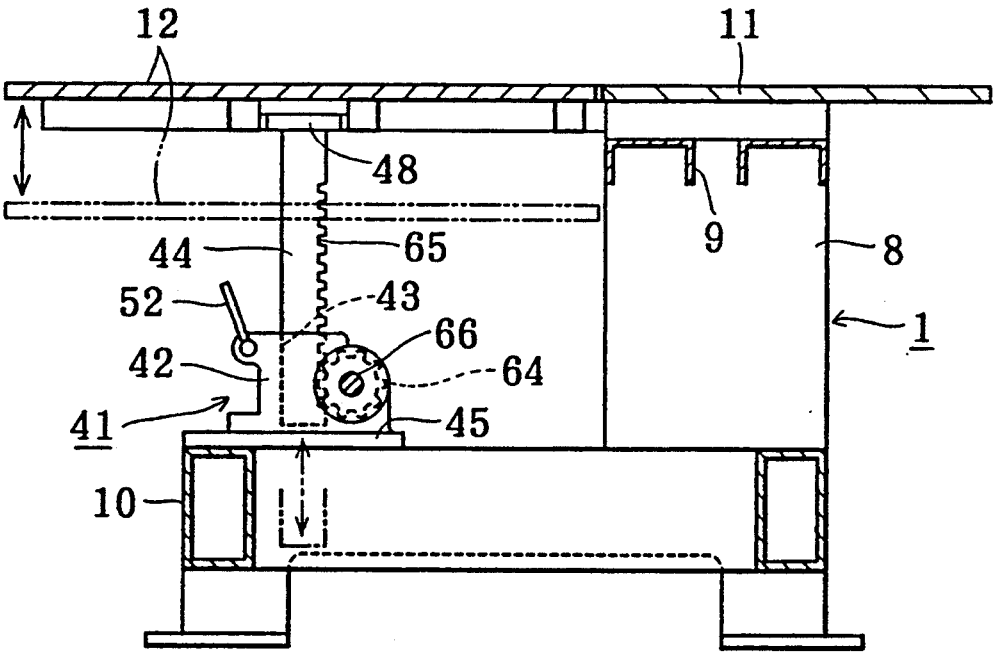
FIG. 7 is a cross-sectional view taken along the line C—C shown in FIG. 6.
Figure 8:
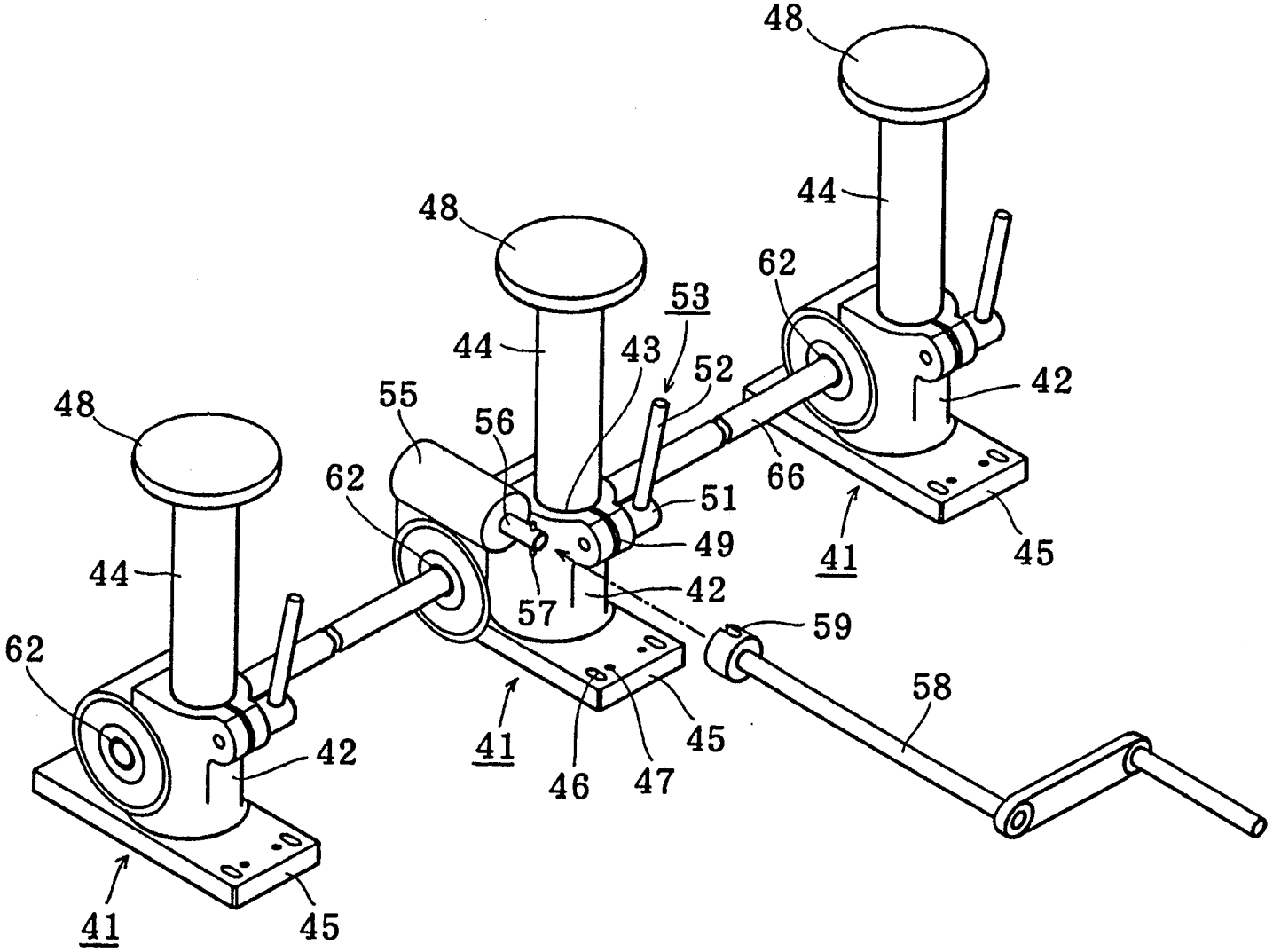
FIG. 8 is a perspective view showing the table supporting means of the embroidery sewing machine according to the present invention.
Figure 9:
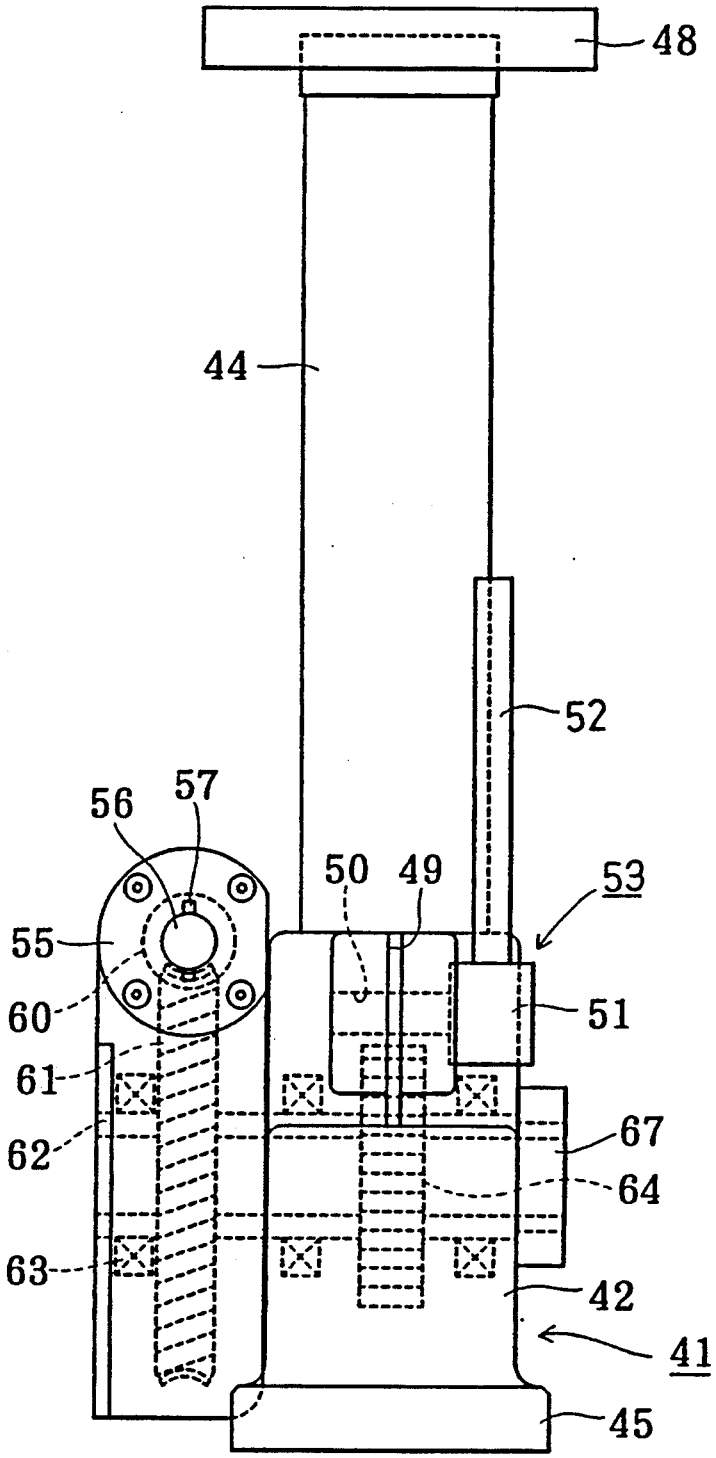
FIG. 9 is a front view showing the table supporting means of the embroidery sewing machine according to the present invention.
Figure 10:
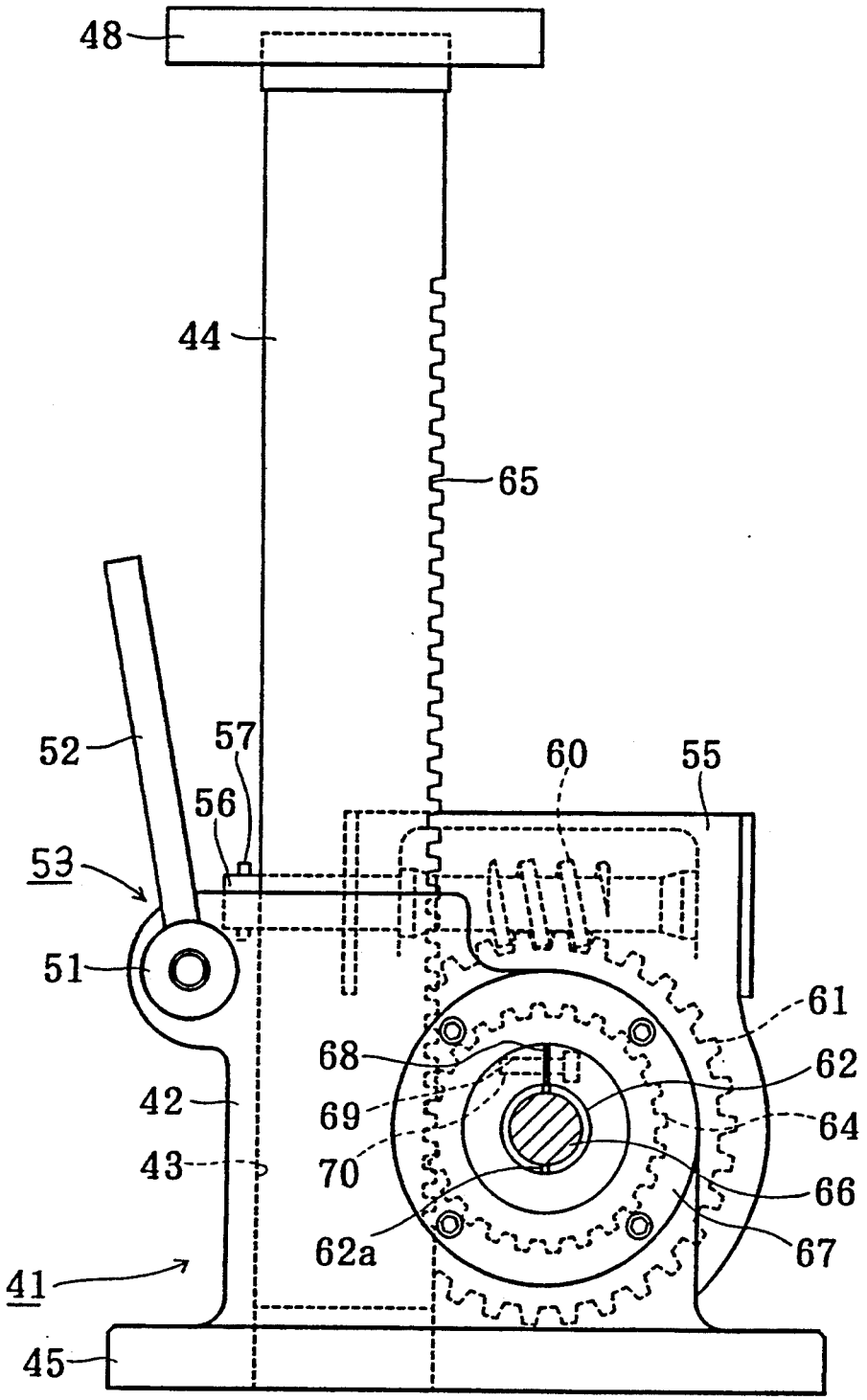
FIG. 10 is a side view showing the table supporting means of the embroidery sewing machine according to the present invention.
Figure 11:
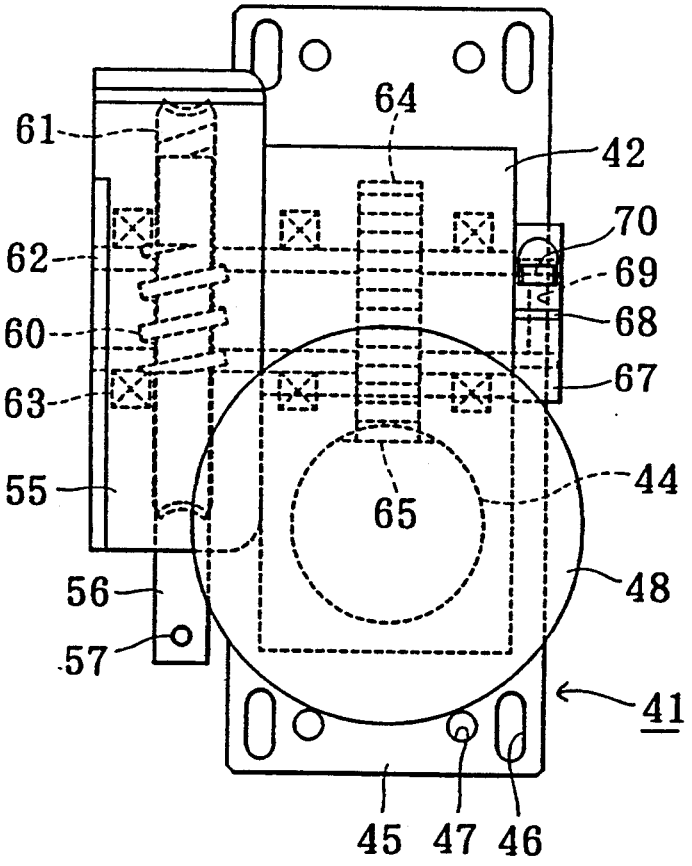
FIG. 11 is a plan view showing the table supporting means of the embroidery sewing machine according to the present invention.

A third embodiment of the present invention will be described with reference to FIG. 5. The point different from the first embodiment is that the following mechanism is additionally provided. In more detail, the up-and-down table 12 is formed with a plurality of grooves **12*b* extending in the front and rear direction, and an attachment 27 is movably fitted by a roller 28 to each of the grooves 12*b* to prevent the front end of the embroidery frame 4 from being pulled down. The attachments 27 are linked with each other via a connecting rod 29. On the connecting rod 29, there are provided support pieces 30 each for supporting the front end portion of the embroidery frame 4 from below. By use of these attachments 27, it is possible to more securely prevent the embroidery frame 4 from being pulled down by a cloth workpiece of large size, in addition to the same effects of the up-and-down table 12** as already explained in the previous embodiments.

A fourth embodiment of the present invention will be described with reference to FIGS. 6 to 11. This embodiment is different from the first embodiment in the supporting means, the holding means and the driving means. In more detail, the up-and-down table 12 is supported by three supporting legs (supporting means) 41 so as to be moved up and down. Each of the supporting legs 41 is composed of a cylindrical fixed leg 42 fixed on the upper surface of the lower beam 10, and a movable leg 44 passed through a guide hole 43 formed in the fixed leg 42 so as to be slidable in the vertical direction. An upper end flange 48 of the middle movable leg 44 is connected to the center of gravity of the up-and-down table 12, and an upper end of each of the right and left movable legs 15 is each connected to one of the two points disposed roughly about the center of gravity of the up-and-down table 12. The fixed leg 42 can be adjustably fixed to the lower beam 10, by fastening bolts (not shown) passed through slots 46 formed in a lower flange 45 of the fixed leg 42. Further, the horizontal level of the fixed leg 42 can be adjusted by bringing bolts (not shown) engaged with the female thread 47 formed in the lower end flange 45 of the fixed leg 42, into contact with the lower beam 10.

Further, the fixed leg 42 is provided with a clamp mechanism 53 for clamping the movable leg 44. In more detail, the fixed leg 42 is formed with a slit 49 at the upper portion thereof and with a female thread hole 50 extending perpendicular to the slit 49. A fastening bolt 51 is screwed into the female thread hole 50 and a lever 52 is attached to the fastening bolt 51. When the up-and-down table 12 is located at a desired height position, the lever 52 of the clamp mechanism 53 is rotated to fasten the movable leg 44, so that the up-and-down table 12 can be prevented from being dropped.

Further, the driving means of this embodiment is constructed as follows: A housing 55 is attached to the left side surface of the fixed leg 42 of the middle support leg 41 of the three support legs 41. An input shaft 56 extending in the front and rear direction is rotatably attached to the upper portion of the housing 55, and two opposing projections 57 are provided for the front end of the input shaft 56. The engage recess 59 formed in a hand handle 58 is engaged with these projections 57. Therefore, when the hand handle 58 is rotated, the input shaft 56 can be rotated together. The input shaft 56 is formed with a worm 60 at the middle portion thereof. Within the housing, a worm wheel 61 in mesh with the worm 60 is so attached as to rotate with a cylindrical shaft 62 extending in the right and left direction. Further, the cylindrical shaft 62 is rotatably supported by bearings 63 within the housing 55.

Further, a pinion 64 is so attached to the cylindrical shaft 62 as to rotate together in an inner space of the fixed leg 42 on the rear side of the guide hole 43. This pinion 64 is in mesh with a rack 65 formed on the rear surface of the movable leg 44. Further, the cylindrical shaft 62, the bearings 63, the pinion 64 and the rack 65 are all provided for the right and left support legs 41, respectively. A single shaft 66 extending in the right and left direction is passed through the cylindrical shaft 62 of the three support legs 41. The cylindrical shaft 62 is formed with a thin thickness portion at the right side projecting from the fixed leg 42. Two opposing slits **62*a* are formed at 180 degree angular intervals in this thin thickness portion of the cylindrical shaft 62. A fastening ring 67 is fitted to the outer circumferential surface of this thin thickness portion. The fastening ring 67 is formed with a slit 68 and a female thread hole 69 extending perpendicular to the slit 68. When a fastening bolt 70 is screwed into the female thread hole 69 to fasten the fastening ring 67 against the cylindrical shaft 62, since the diameter of the cylindrical shaft 62 is reduced at the slit 62*a* to chuck the shaft 66, it is possible to rotate the shaft 66 together with the respective cylindrical shafts 62**.

Accordingly, when the manually operated handle 58 is engaged with the input shaft 56 of the middle support leg 41 and further rotated manually to rotate the input shaft 56 and the worm 60, since the worm wheel 61, the cylindrical shaft 62, the shaft 66 and the pinions 64 of the respective support legs 41 are all rotated slowly, the rotational motion of these elements is converted into the vertical motion of the rack 65, so that the movable legs 44 of the respective support legs 41 are moved up and down simultaneously. That is, the up-and-down table 12 can be moved up to the upward position and down to any desired downward position continuously movably. Thereafter, even if the hand handle 58 is removed from the input shaft 56, since the worm 60 will not be rotated by the rotational force of the worm wheel 61, the worm 60 functions as the holding means to the up-and-down table 12. In addition, when the movable legs 44 are fastened by the clamping mechanisms 53, it is possible to obtain the additional effects as follows:

In this fourth embodiment, the following effects can be obtained in addition to the effect of the first embodiment.

(1) In comparison with the first embodiment, since the number of parts of the supporting means, the holding means and the driving means of the up-and-down table 12 can be reduced, the assembling productivity can be increased and further the cost thereof can be decreased.

(2) Since the upper ends of the movable legs 44 are connected to the points where the up-and-down table 12 is supported to be balanced, it is possible to move the up-and-down table 12 up and down more smoothly.

(3) When the movable legs 44 are fastened as described above, it is possible to prevent the up-and-down table 12 from being vibrated during the operation of the embroidery sewing machine, in addition to the prevention of the up-and-down table 12 from being dropped down.

(4) Since the supporting means, the holding means and the driving means are all not projected frontward from the lower beam 10, it is possible to provide a large space to the workers.

A fifth embodiment of the present invention will be described with reference to FIGS. 12 to 16. This embodiment is different from the first embodiment in the supporting means, the holding means, and the auxiliary driving means of the up-and-down table 12. In more detail, the supporting means of this embodiment is of parallel crank mechanism which is composed of a coupling member 71 fixed to the lower side of the up-and-down table 12, a rear post 72 of the machine frame 1, and a pair of upper and lower crank arms 77 and 78 whose front ends are rotatably connected to a coupling member 71 by axles 73 and 74 and whose rear ends are rotatably connected to the rear post 72 by axles 75 and 76. The upper crank arm 77 is of L shape. However, the line connecting between the axles 73 and 75 of the upper crank arm 77 is parallel to the line connecting between the axles 74 and 76 of the lower crank arm 78. Further, the line connecting between the axles 73 and 74 and the line connecting between the axles 75 and 76 are both vertical, and the axles 75 and 76 of the rear post 72 are fixed nodes, respectively. Therefore, when the crank arms 77 and 78 of the parallel crank mechanism are pivoted, it is possible to move the up-and-down table 12 in accordance with parallel motion.

Figure 12:
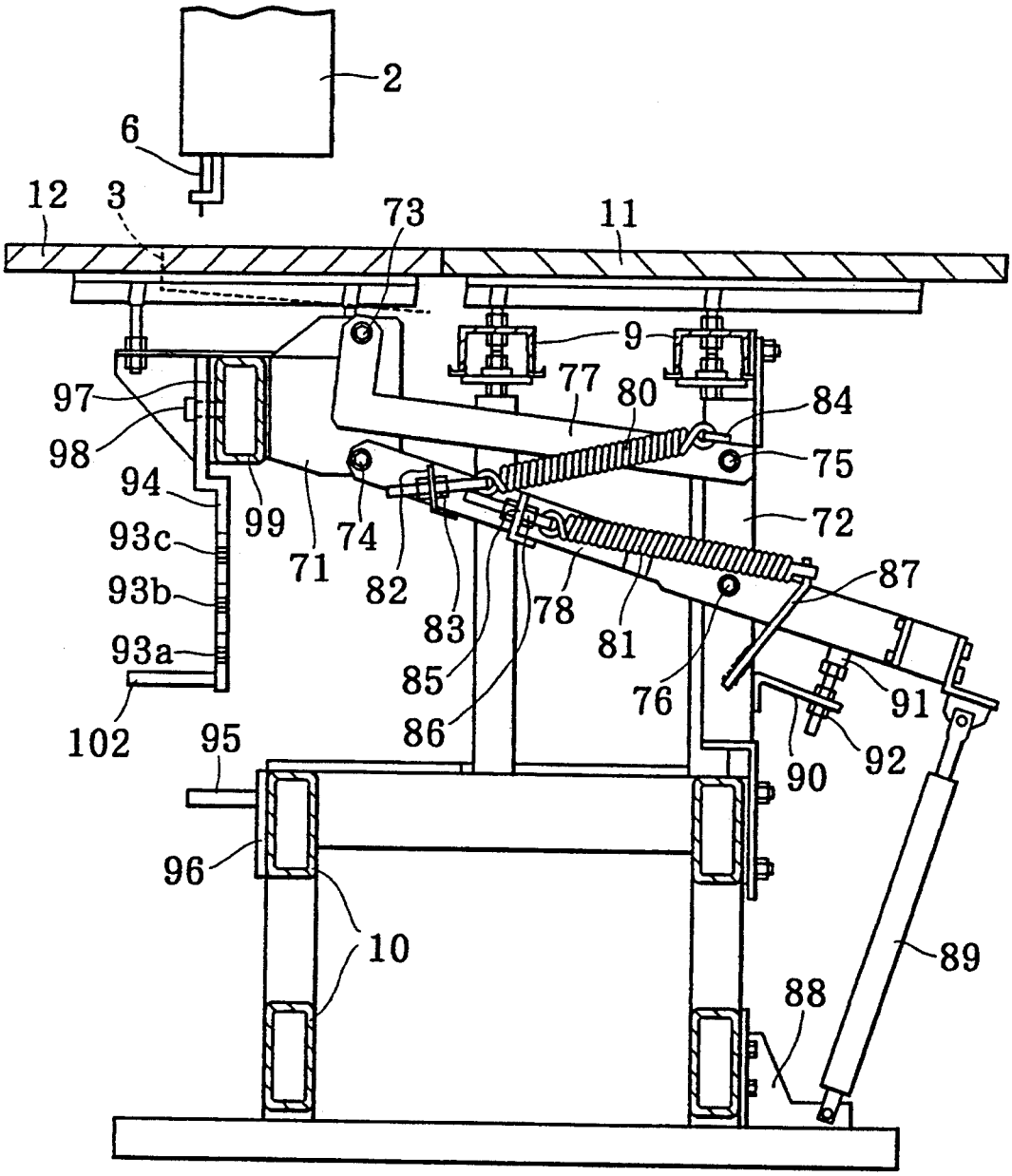
FIG. 12 is a cross-sectional view showing a fifth embodiment of the embroidery sewing machine according to the present invention, in which the up-and-down table is located at the upward position.
Figure 13:
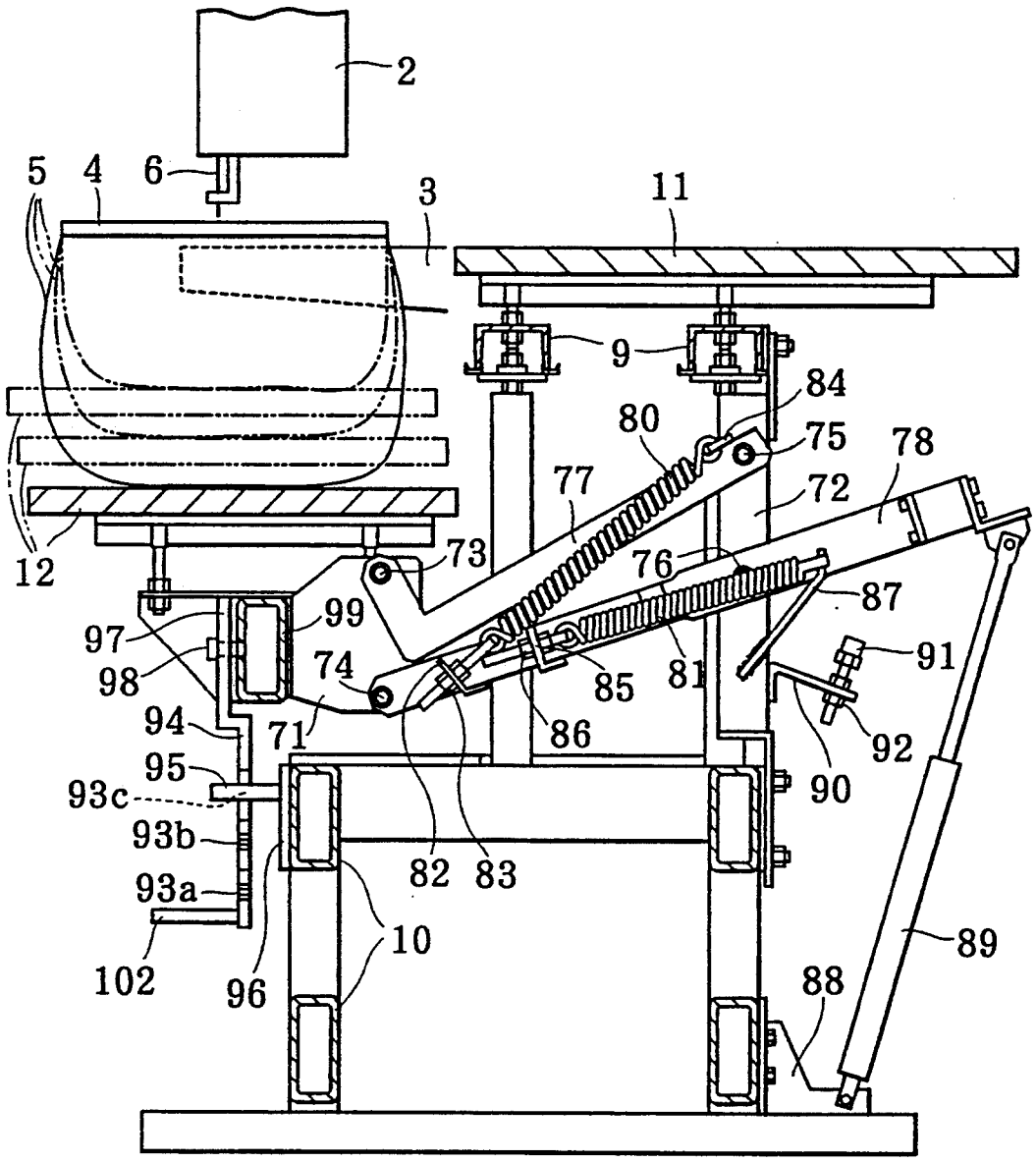
FIG. 13 is a cross-sectional view showing the fifth embodiment of the embroidery sewing machine according to the present invention, in which the up-and-down table is located at the downward position.
Figure 14:
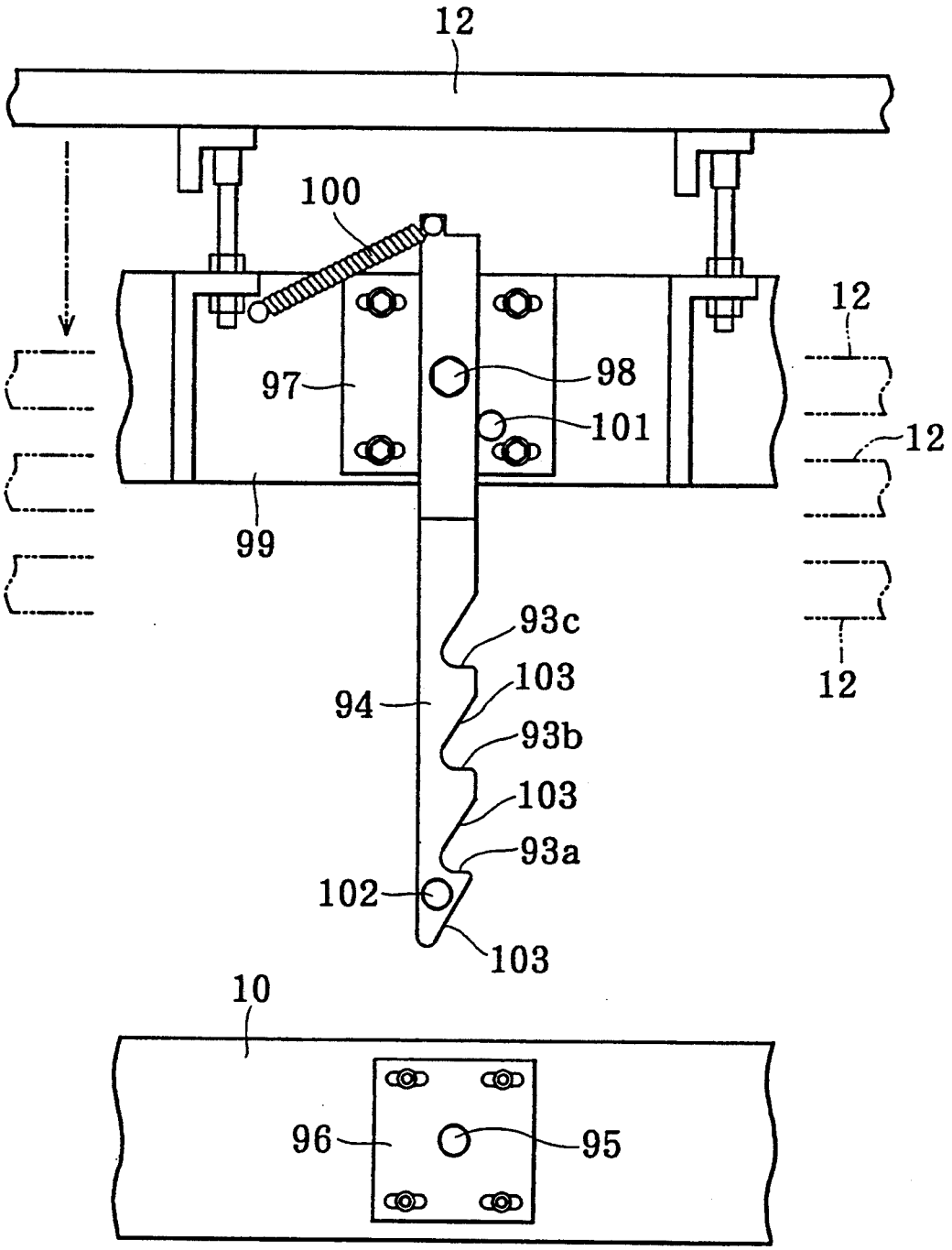
FIG. 14 is a partial front view showing the fifth embodiment of the embroidery sewing machine according to the present invention, in which the up-and-down table is located at the upward position.

In this embodiment, although the up-and-down table 12 is moved manually, auxiliary driving means is additionally provided to reduce the manual driving force. However, it is of course possible to use other driving means such as electric, pneumatic, hydraulic driving means. The auxiliary driving means includes an upper coil spring 80 and a lower coil spring 81. The front end of the upper coil spring 80 is connected to a bracket 82 fixed (e.g. by welding) near the front end of the lower crank arm 78 through an adjust screw 83. The rear end of the upper coil spring 80 is connected to a bracket 84 (located a little upward away from the axle 75) fixed (e.g. by welding) near the rear end of the upper crank arm 77. The screw adjusting member 83 includes means for adjusting the tension of the coil spring 80. Therefore, the upper coil spring 80 slightly pulls upward the front end of the lower crank arm 78 under the contraction condition as shown in FIG. 12, and strongly pulls upward the lower crank arm 78 under the expansion condition as shown in FIG. 13. That is, the upper coil spring 80 applies an upward force to the up-and-down table 12 at all times.

The front end of the lower coil spring 81 is connected to a bracket 85 fixed (e.g. by welding) to the middle portion of the lower crank arm 78 through an adjust member 86. The rear end of the lower coil spring 81 is connected to a bracket 87 fixed (e.g. by welding) to the rear post 72. The screw adjusting member 86 includes means for adjusting the tension of the coil spring 81. When the up-and-down table 12 is moved upward as shown in FIG. 12, since the connection point between the lower coil spring 81 and the bracket 87 is located upward away from the line connecting between the axles 74 and 76, the lower coil spring 81 pulls upward the front end of the lower crank arm 78, so that an upward force is applied to the up-and-down table 12. On the other hand, when the up-and-down table 12 is moved downward as shown in FIG. 13, since the connection point between the lower coil spring 81 and the bracket 87 is located downward away from the line connecting between the axles 74 and 76, the lower coil spring 81 pulls downward the lower crank arm 78, so that a downward force is applied to the up-and-down table 12 to assist the holding operation of the up-and-down table 12 at the downward position.

Here, the tensions of the coil springs 80 and 81 are adjusted by the adjusting members 83 and 86 in such a way that the upward forces of the upper and lower coil springs 80 and 81 are slightly stronger than the weight of the up-and-down table 12 (a force corresponding to a difference between both is referred to as an excessive force, hereinafter), under the conditions that the up-and-down table 12 is located between the upward position as shown in FIG. 12 and the downward position as shown in FIG. 13. Further, the excessive force of the coil springs 80 and 81 is so determined as to become the same extent as the frictional forces of the respective members of the parallel mechanism.

The rear end of the lower crank arm 78 extends rearward beyond the axle 76. A hydraulic or gaseous cylinder 89 is connected between the rear end of the lower crank arm 78 and a bracket 88 disposed at the lower end of the machine frame 1, as means for damping the up-and-down motion of the up-and-down table 12. Further, a bracket 90 is fixed (e.g. by welding) to the rear post 72, and a stopper 91 is attached to this bracket 90 through a screw adjusting member 92 for limitation of the pivotal motion of the lower crank arm 78, due to contact of this stopper 91 with the lower surface of the rear end portion of the lower crank arm 78 when the up-and-down table 12 is moved in the upward direction as shown in FIG. 12.

Further, the holding means of this embodiment is composed of a first engage member 94 extending vertically and formed with three engage grooves **93*a*, 93*b* and 93*c* of different height (the number of the grooves is not limited to only three), and a second engage member (engage projection) 95 so as to be engageable with and disengageable from any one of the engage grooves 93*a*, 93*b* and 93*c*. Each of the engage grooves 93 is formed with a lower horizontal side 93 and an upper oblique side 103. The first engage member 94 is pivotally attached to a mounting plate 97 by an axle 98. The mounting plate 97 is fixed by screws to the front surface of a table beam 99 fixed to the lower side of the up-and-down table 12. On the other hand, the second engage member (projection) 95 is fixed to a mounting plate 96, which is fixed by screws to the front surface of the lower beam 10 of the machine frame 1. Further, a holding coil spring 100 is attached between the upper end of the first engage member 94 and the table beam 99, to urge the first engage member 94 in the direction that the engage projection 95 is kept engaged with one of the engage grooves 93 of the first engage member 94. The mounting plate 97 is provided with a limit projection 101 for limiting the pivotal motion of the first engage member 94. Further, a holding rod 102 is provided at the lower end of the first engage member 94 to manually disengage the engage projection 95 from one of the engage grooves 93 of the first engage member 94**.

The effects of this embodiment are basically the same as those of the first embodiment, except the following supplementary explanation. In this embodiment, since the upward forces of the upper and lower coil springs 80 and 81 are slightly stronger than the weight of the up-and-down table 12, when the up-and-down table 12 is moved manually from the upward position as shown by the solid lines in FIGS. 12 and 14 (by the dot-dot-dashed lines in FIGS. 15 and 16) to the downward position as shown by the solid line in FIGS. 13, 15 and 16, it is possible for the worker to lower the up-and-down table 12 easily by slightly pushing the up-and-down table 12 downward against the excessive force of the coil springs 80 and 81, without supporting the weight of the up-and-down table 12. In addition, since the cylinder 89 can damp the shock caused by an abrupt downward motion of the up-and-down table 12, it is possible to lower the up-and-down table 12 safely.

When the up-and-down table 12 is moved in the downward direction, since the lowermost oblique side 103 of the first engage member 94 is pushed in the horizontal direction in contact with the engage projection 95, the first engage member 94 is slightly pivoted and then returned to the original position by an elastic force of the holding coil spring 100, so that the lowermost engage groove 93*a* is engaged with the engage projection 95 (this engage status is not shown), so that it is possible to prevent the up-and-down table 12 from being raised from the downward position by an elastic force of the upper coil spring 80. On the other hand, the downward motion of the up-and-down table 12 is mainly prevented by the upper coil spring 80. Under these conditions, the up-and-down table 12 is located at the highest position of the three-stage downward positions.

Figure 15:
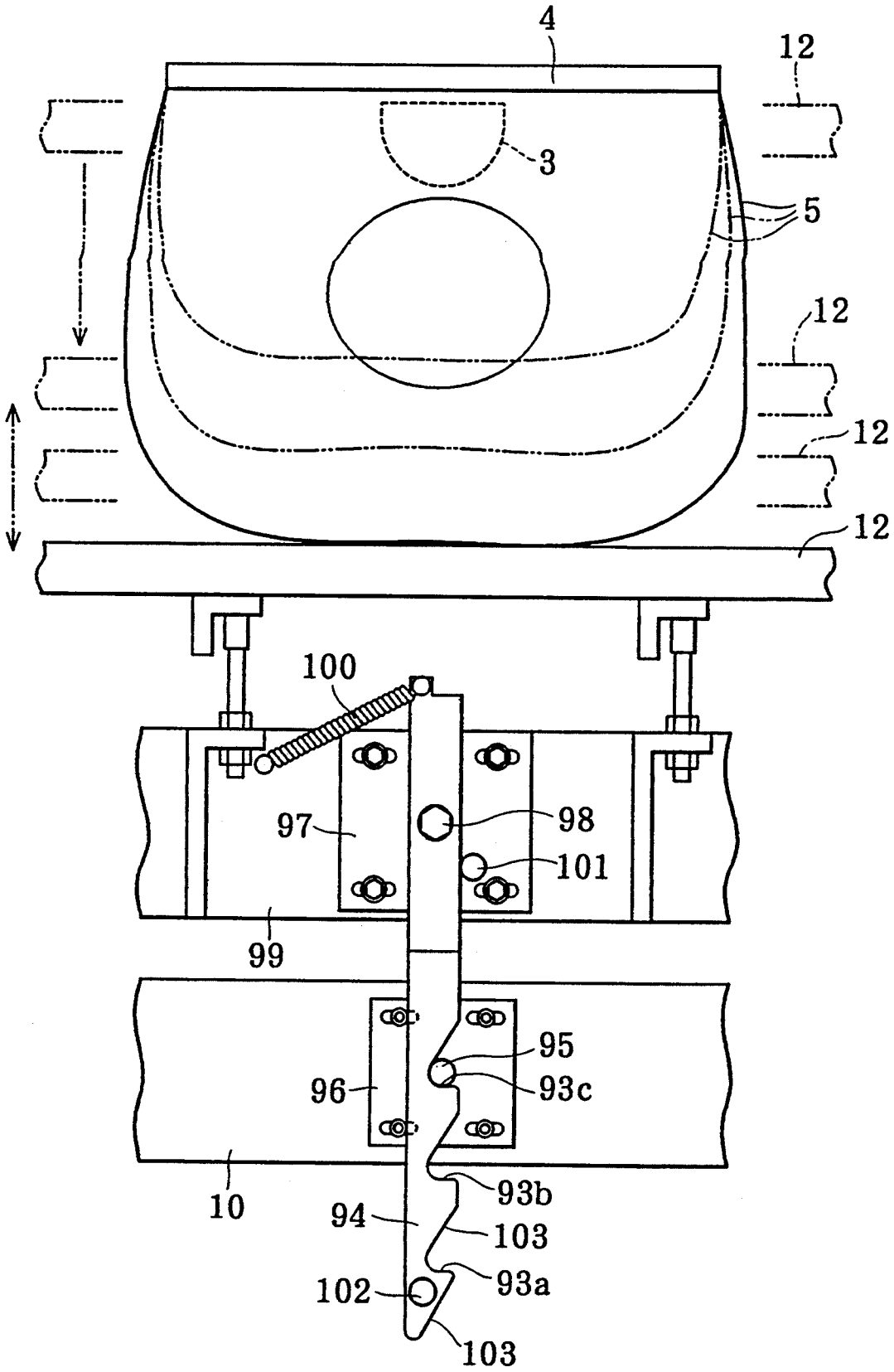
FIG. 15 is a partial front view showing the fifth embodiment of the embroidery sewing machine according to the present invention, in which the up-and-down table is located at the downward position.
Figure 16:
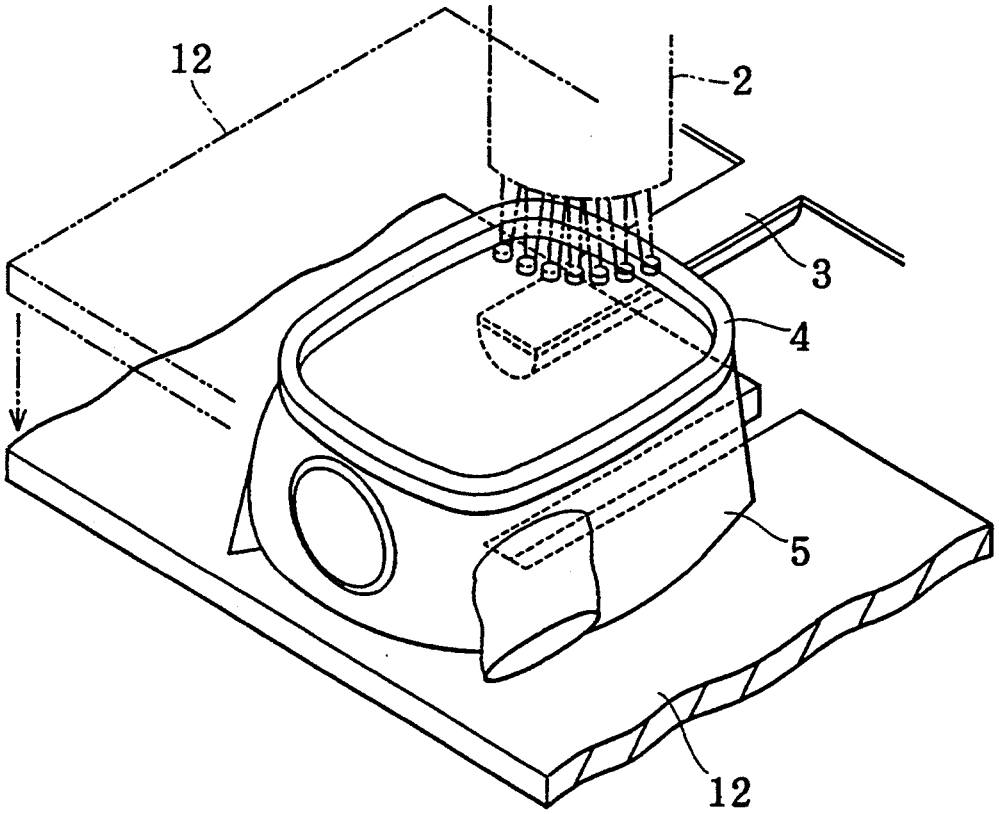
FIG. 16 is a perspective view showing the fifth embodiment of the embroidery sewing machine according to the present invention, in which the up-and-down table is located at the downward position.

Here, when the downward position of the up-and-down table 12 is required to be more lowered, the up-and-down table 12 is further pushed downward. Then, the engage projection 95 is slid along the oblique side 103 Just over the lowermost engage groove 93*a*, as shown in FIG. 15, so that the engage projection 95 is engaged with the engage groove 93*b* or further with the engage groove 93*c*. Further, when the engage projection 95 is engaged with the uppermost engage groove 93*c*, since the lower coil spring 81 pulls downward the lower crank arm 78 as already explained, the up-and-down table 12 is held stably at its position.

On the other hand, when the up-and-down table 12 is required to be raised from the downward position or up to the upward position, by gripping and pivoting the holding rod 102 fixed to the first engage member 94, the engage groove 93*a* can be disengaged from the engage projection 95, before raising the up-and-down table 12 manually. Under these conditions, since the upward forces of the upper and lower coil springs 80 and 81 are slightly stronger than the weight of the up-and-down table 12 as already described, it is possible for the worker to raise the up-and-down table 12 easily by slightly pushing the up-and-down table 12 upward, because of the aid of the excessive force of the coil springs 80 and 81 without bearing up all the weight of the up-and-down table 12. In addition, since the cylinder 89 can damp the shock caused by an abrupt upward motion of the up-and-down table 12, it is possible to raise the up-and-down table 12 safely.

If the excessive force of the coil springs 80 and 81 is determined to be larger than the frictional forces of the respective members of the parallel link mechanism, the up-and-down table 12 can be raised automatically by the excessive force. Therefore, in this case, the coil springs 80 and 81 function as the driving means. In this case, however, a larger manual force is inevitably required to lower the up-and-down table 12.

As described above, since the up-and-down table 12 can be located at the downward positions of three different stages (heights), it is possible to adjust the position at which the hanging down end portion of the cloth workpiece 5 can be received according to the kind or the size of the cloth, as shown in FIGS. 13 and 15.

A sixth embodiment of the present invention will be described with reference to FIGS. 17 to 22. This embodiment is different from the fifth embodiment only in the holding means of the up-and-down table 12. In the holding means of this embodiment, the first engage member 94 is fixed to the mounting plate 97 with screws, and further each engage groove (e.g. 93*a*) is formed with an upper side composed of a horizontal portion and an oblique portion 103. In addition, the second engage member 95 is formed with a pivotal member 105 on which an engage projection 104 is implanted. The pivotal member 105 is pivotally attached to the mounting plate 96 by an axle 106. A holding coil spring 107 is attached between the pivotal member 105 and the left end portion of the mounting plate 96 in order to urge the pivotal member 105 in the direction that the engage projection 104 is kept engaged with one of the engage grooves 93 of the first engage member 94.

Figure 20:
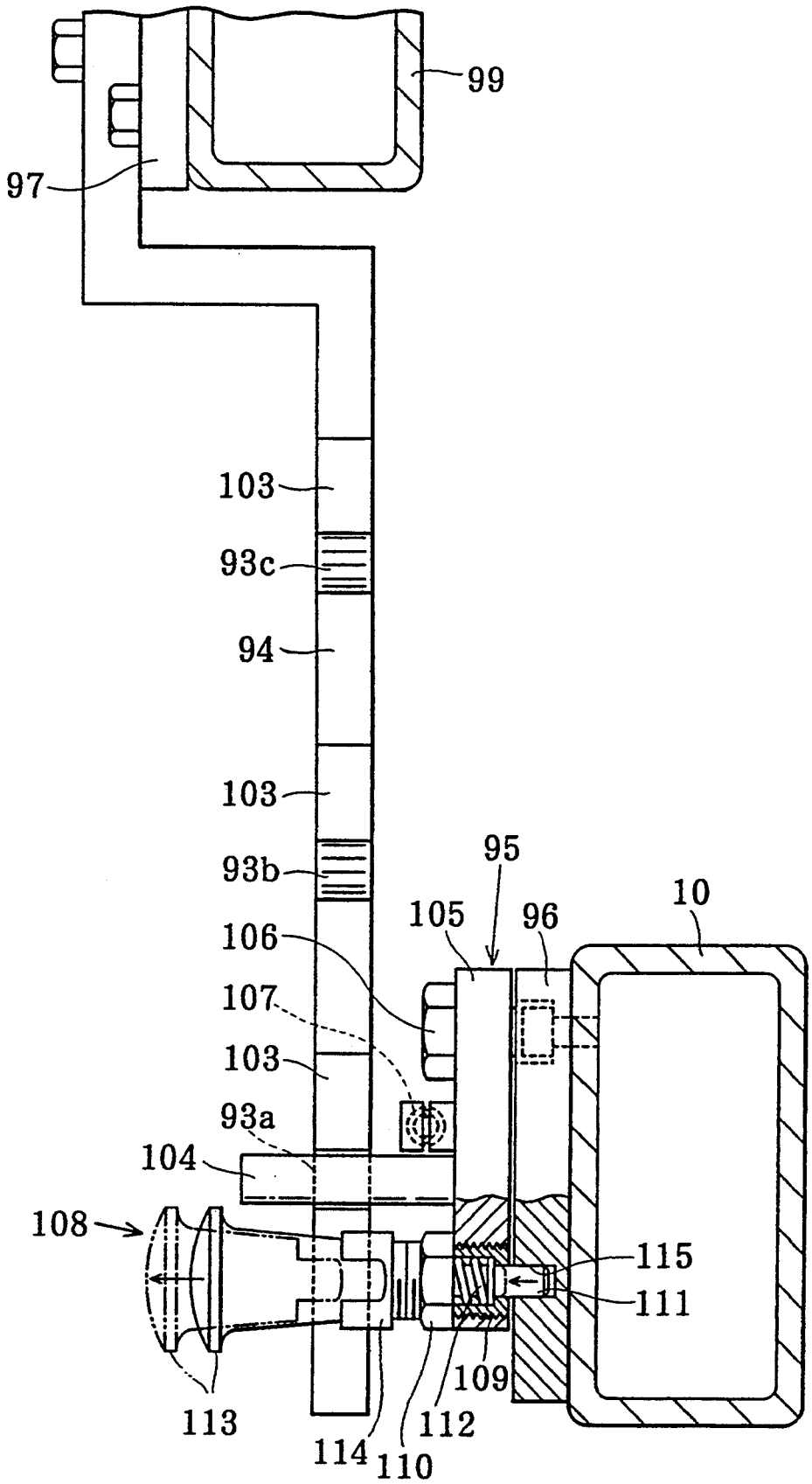
FIG. 20 is a right side view showing the sixth embodiment of the embroidery sewing machine according to the present invention shown in FIG. 19.

A lock device 108 as shown in FIG. 20 is mounted on the lower portion of the pivotal member 105. This lock device 108 is composed of a cylindrical member 109 formed with a male thread screwed into the pivotal member 105, a lock nut 110 of the cylindrical member 109, a lock pin 111 formed with a flange portion movable within the cylindrical member 109, a coil spring 112 for urging the lock pin 111 against the mounting plate 96 in contact with the flange portion of the lock pin 111, an operation knob 113 for pulling the lock pin 111 in the frontward direction, and a holding member 114 for holding the operation knob 113 under the condition that the knob 113 is pulled frontward. In addition, the mounting plate 96 is formed with a lock hole 115 into which the lock pin 111 can be inserted when the engage projection 104 is engaged with one of the engage grooves 93, and an arcuate slot 116 into which the lock pin 111 can be inserted when the engage projection 104 is disengaged from one of the engage grooves 93.

Figure 17:
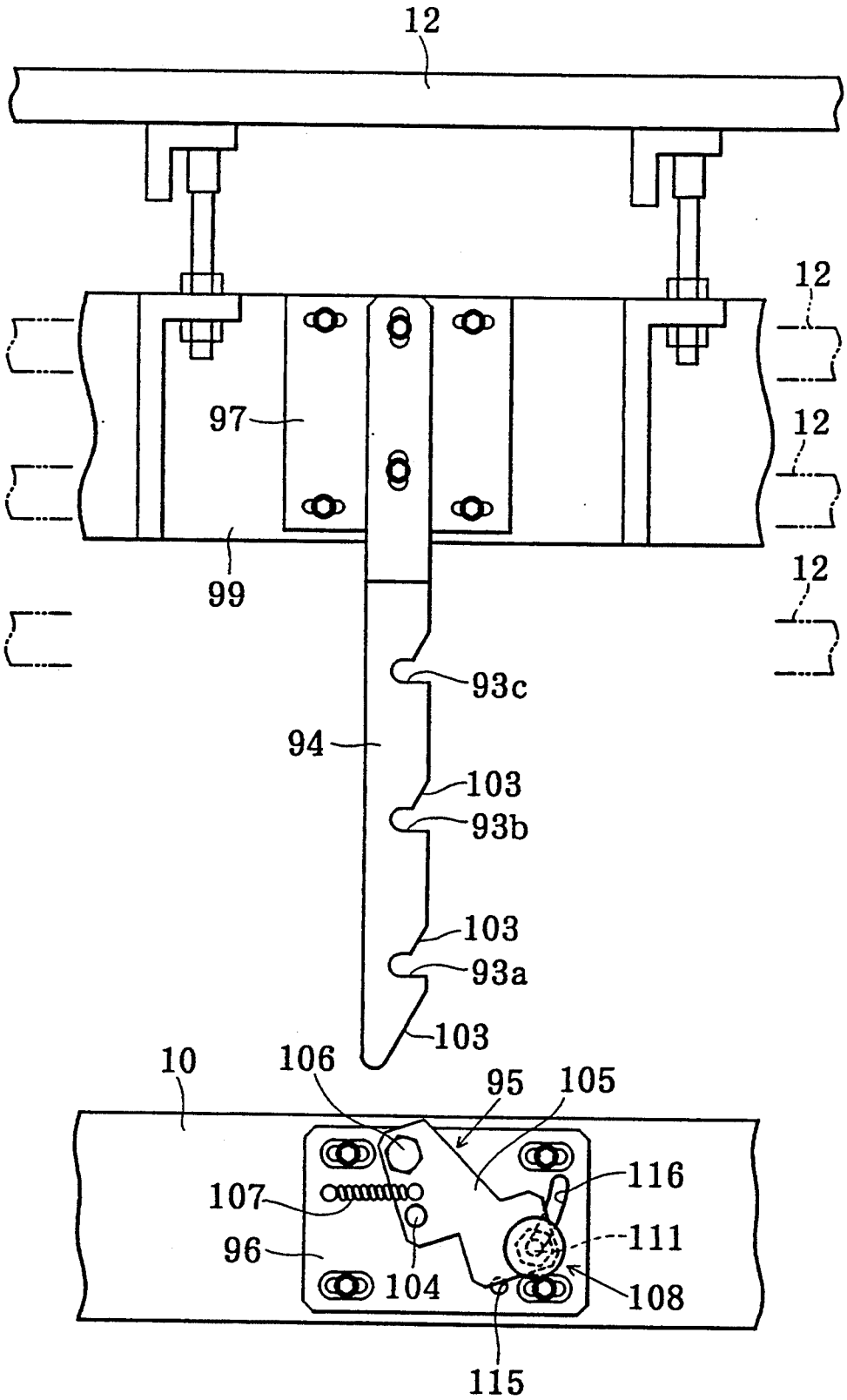
FIG. 17 is a partial front view showing a sixth embodiment of the embroidery sewing machine according to the present invention, in which the up-and-down table is located at the upward position.
Figure 18:
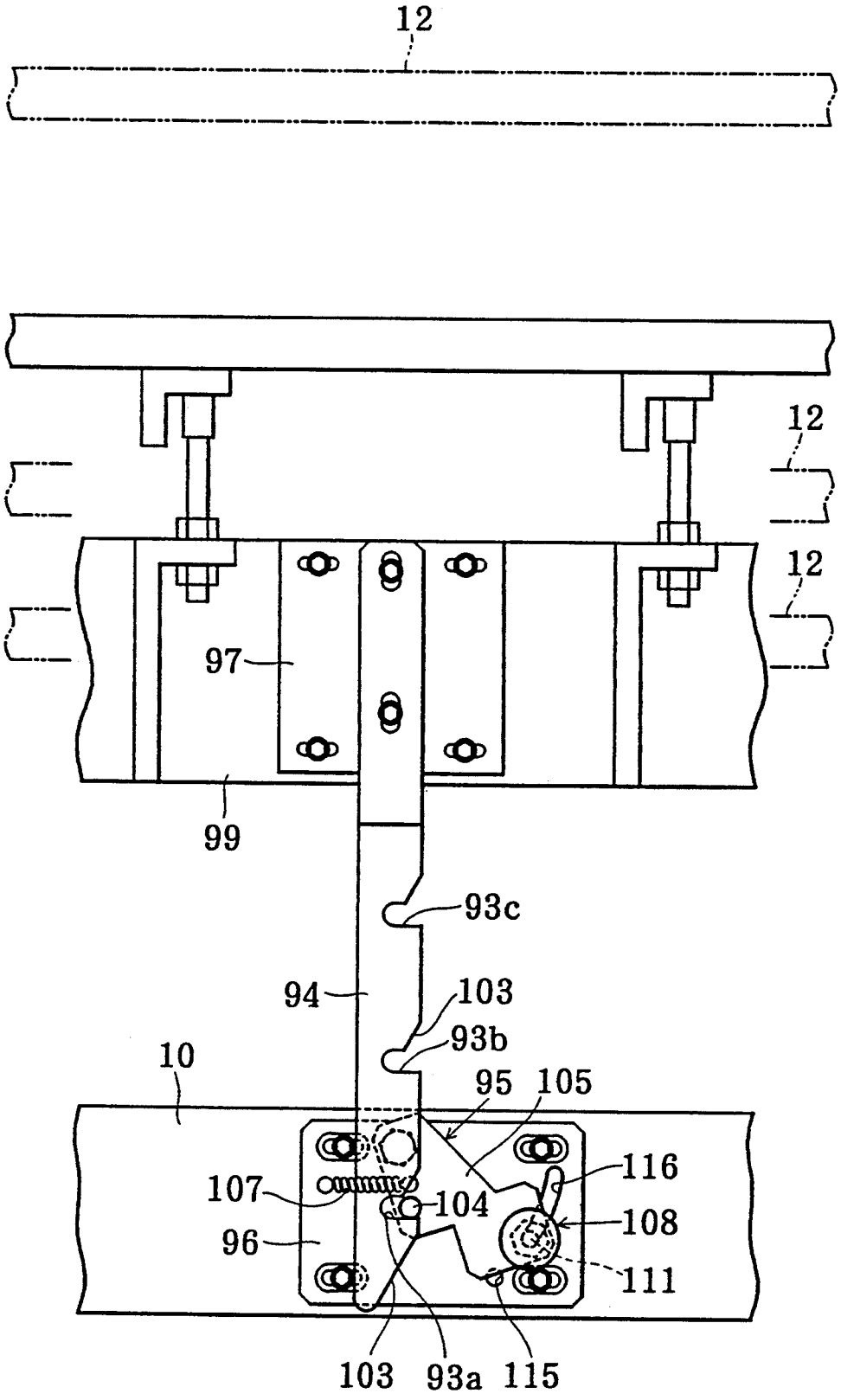
FIG. 18 is a partial front view showing the sixth embodiment of the embroidery sewing machine according to the present invention, in which the up-and-down table is moved down.
Figure 19:
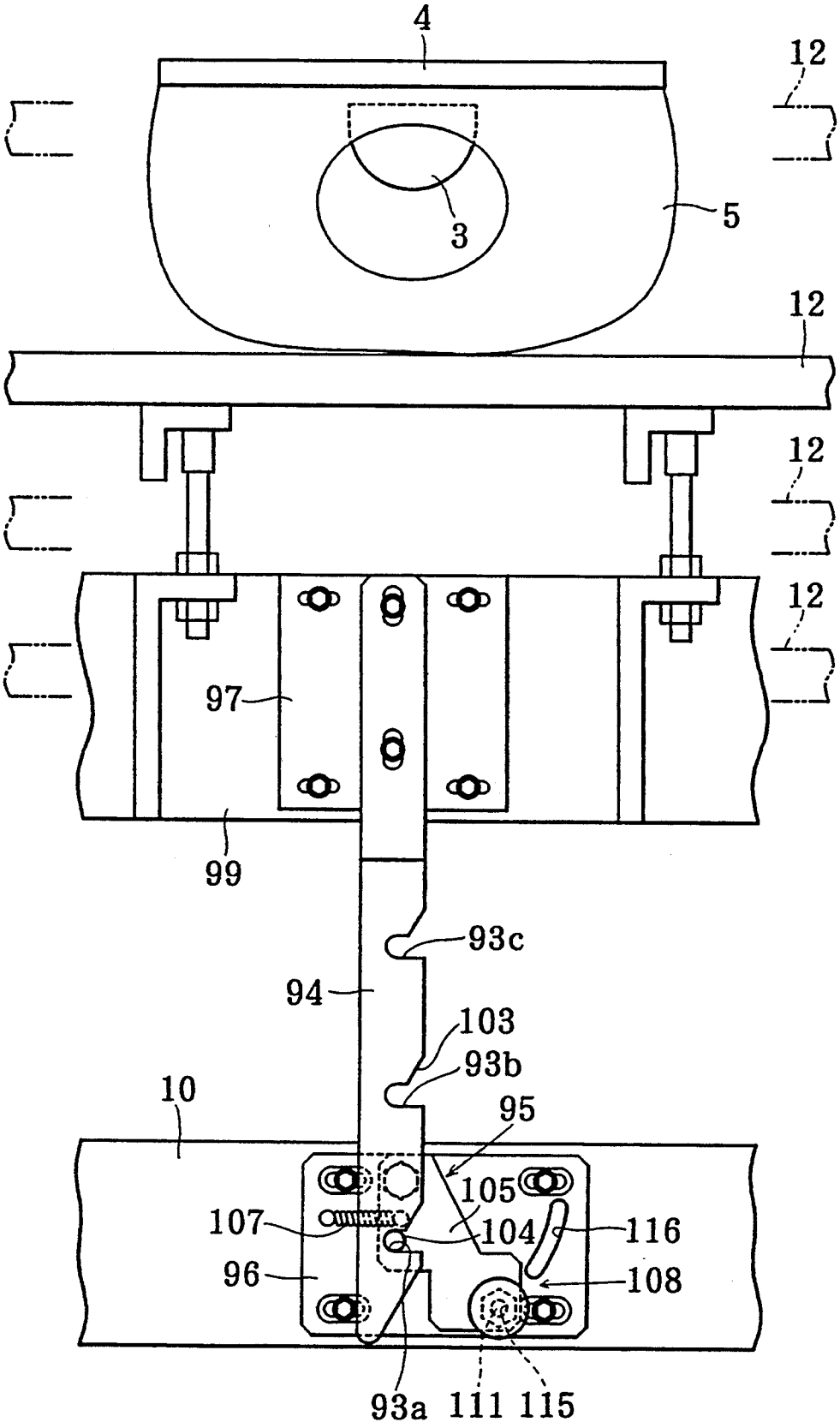
FIG. 19 is a partial front view showing the sixth embodiment of the embroidery sewing machine according to the present invention, in which the up-and-down table is kept located at the downward position.

The holding means of this embodiment functions as follows: when the up-and-down table 12 is located at the upward position as shown in FIG. 17, the lock pin 111 is inserted into the lower end of the arcuate slot 116. When the up-and-down table 12 is lowered from this position, since the lower end of the oblique side 103 of the first engage member 94 pushes the engage projection 104 in the horizontal direction, the pivotal member 105 is slightly pivoted and then returned to the original position by an elastic force of the holding coil spring 107, so that the engage projection 104 is just engaged with the engage groove 93*a* of the first engage member 94 as shown in FIG. 18. Under these conditions, the lock pin 111 is removed from the arcuate slot 116 to pivot the pivotal member 105 as shown in FIGS. 19 and 20, until the engage projection 104 is perfectly engaged with the engage groove 93*a* and thereby the lock pin 111 can be inserted into the lock hole 115. The lock pin 111 inserted into the lock hole 115 can prevent the engage projection 104 from being disengaged from the engage groove 93*a*, with the result that the up-and-down table 12 can be perfectly prevented from being moved up and down thereafter. Under these conditions, the up-and-down table 12 is located at the highest position of the three-stage downward positions.

Figure 21:
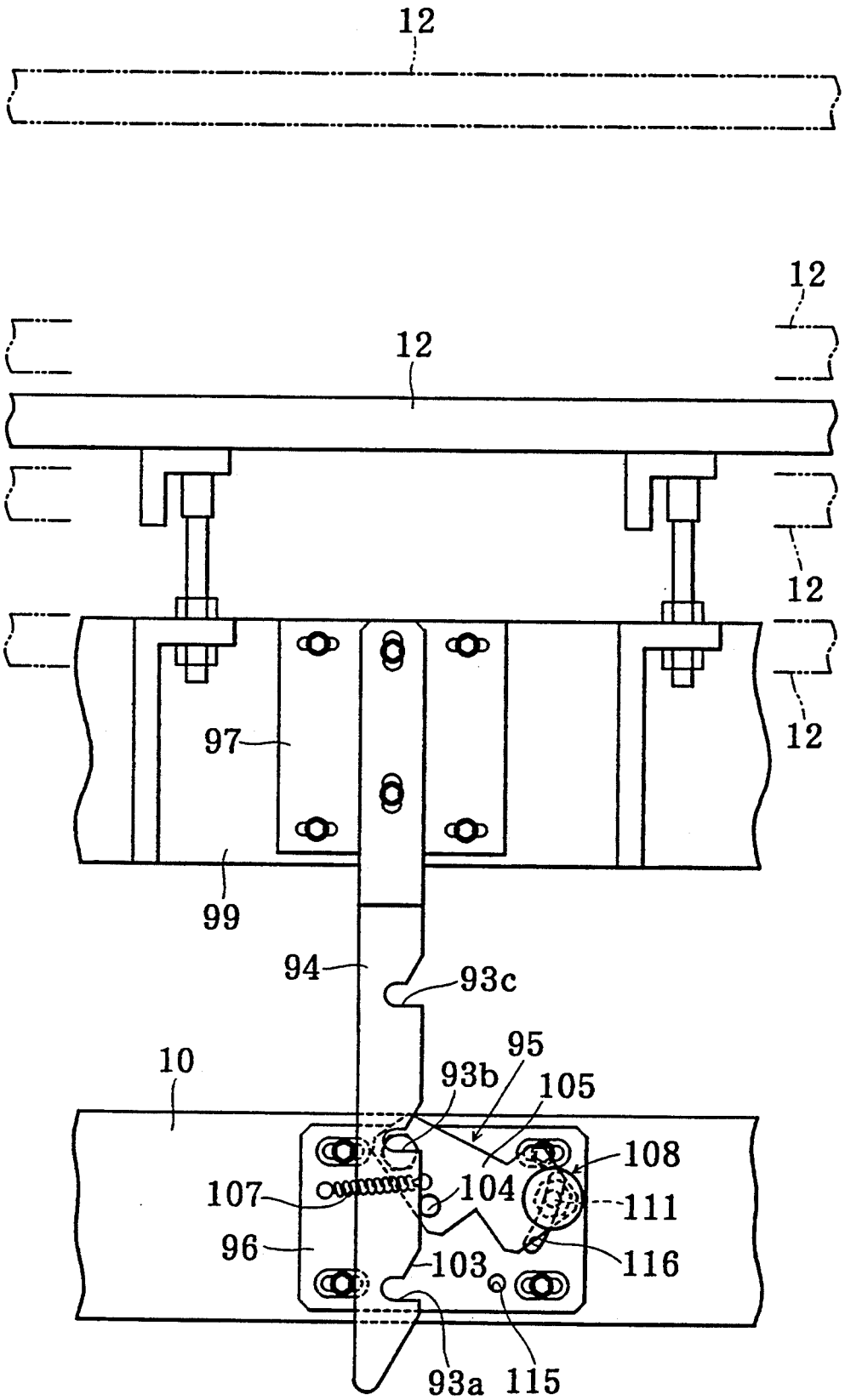
FIG. 21 is a partial front view showing the sixth embodiment of the embroidery sewing machine according to the present invention, in which the up-and-down table is further moved down midway.

Here, when the up-and-down table 12 is required to be more lowered, the lock pin 111 is removed from the lock hole 115 as shown by the arrow and dot-dot-dashed lines in FIG. 20, and the lock pin 111 is inserted into the lower end of the arcuate slot 116, as shown in FIG. 18. When the up-and-down table 12 is lowered from this position, the engage projection 104 is disengaged from the engage groove 93*a* as shown in FIG. 21 and engaged with the upward engage groove 93*b* (this engage state is not shown), after having been slid along the oblique side 103 just over the engage groove 93*a* and further the vertical right side surface of the first engage member 94.

Figure 22:
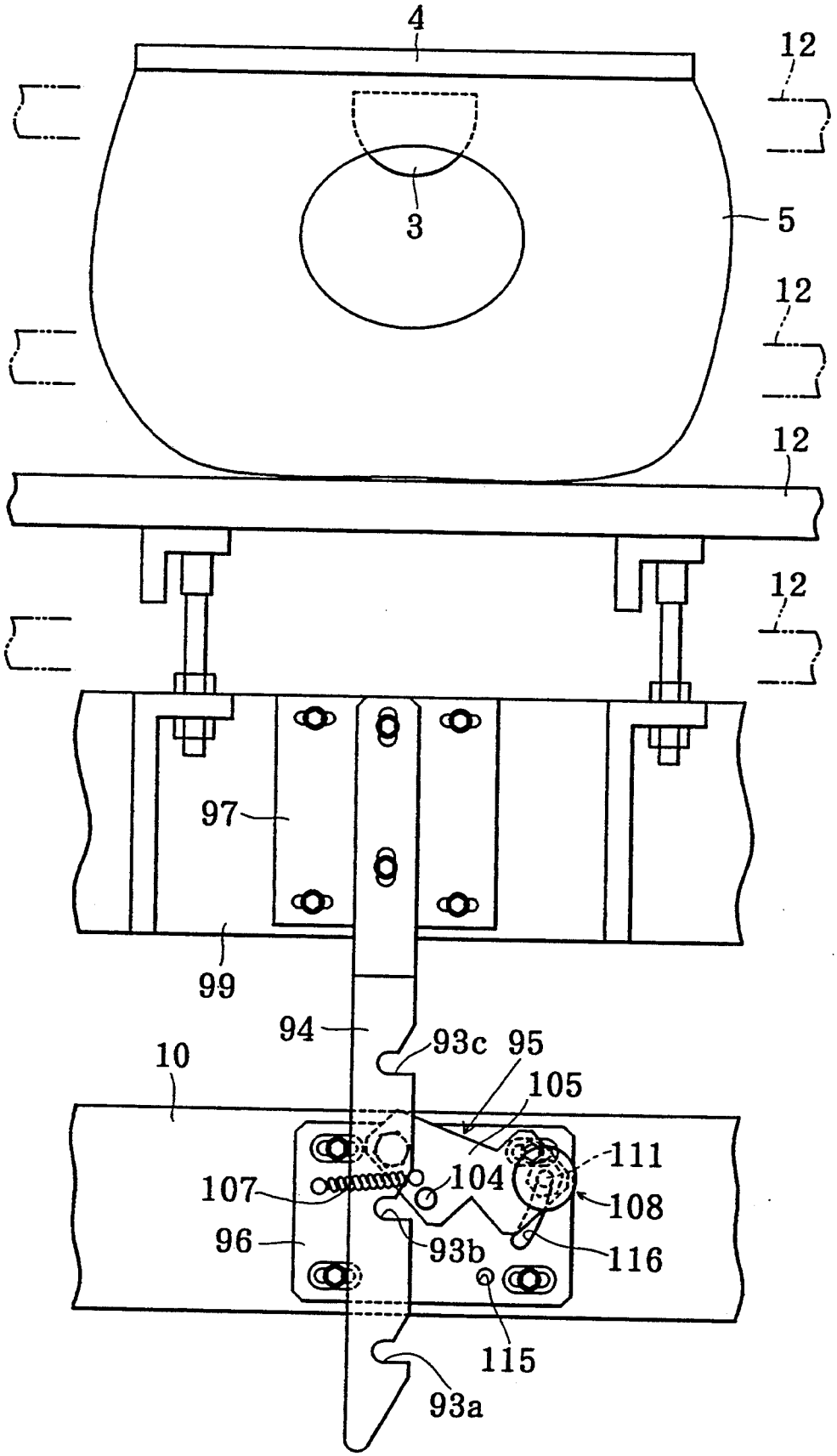
FIG. 22 is a partial front view showing the sixth embodiment of the embroidery sewing machine according to the present invention, in which the up-and-down table is not yet moved upward.

On the other hand, when the up-and-down table 12 is required to be returned to the upward position, the pivotal member 105 is pivoted until the lock pin 111 is slid along the arcuate slot 116 to the upper end thereof, as shown in FIG. 22. Under these conditions, since the engage projection 104 is perfectly disengaged from the engage groove 93*b*, the up-and-down table 12 can be raised manually.

Figure 23:
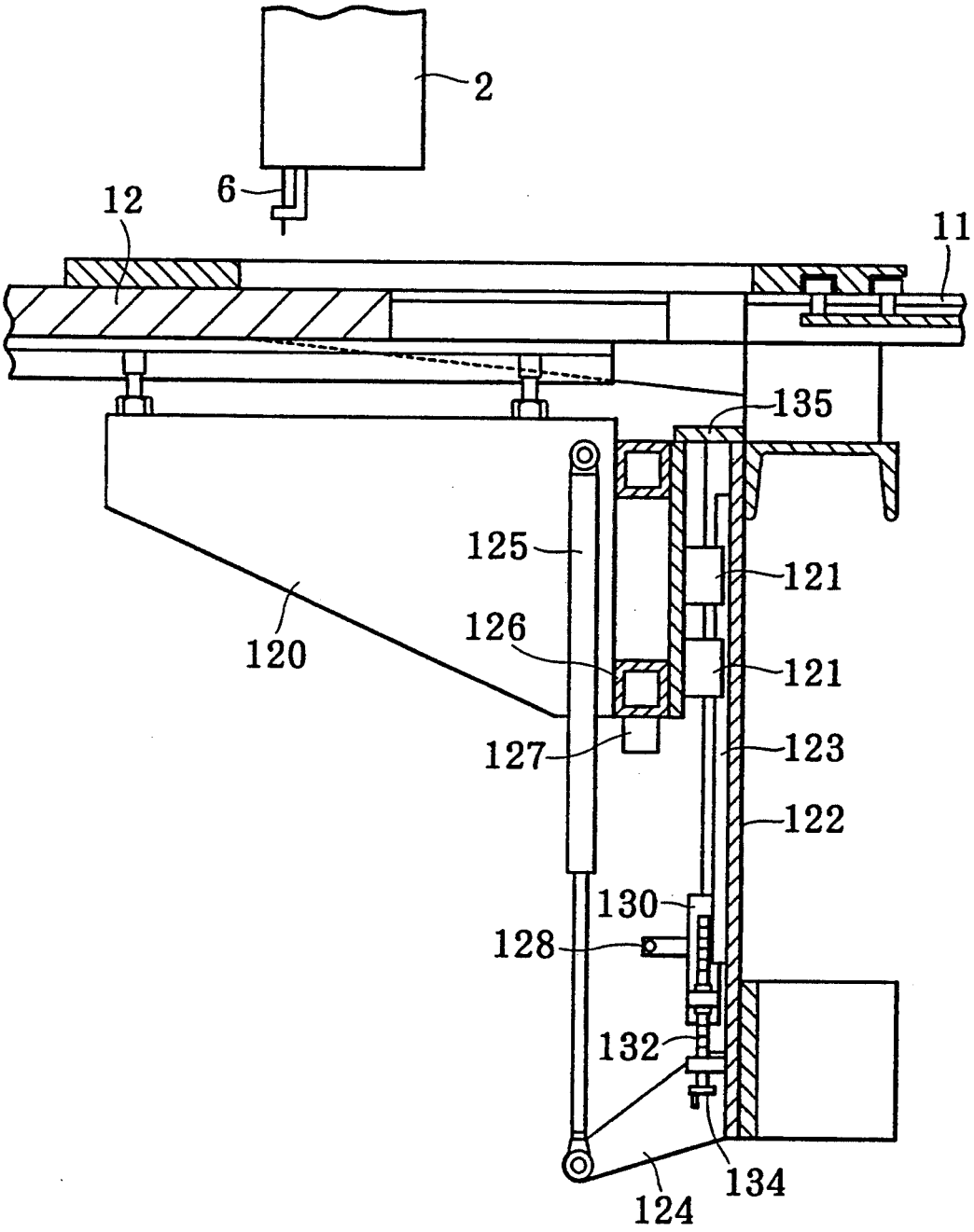
FIG. 23 is a cross-sectional view showing a seventh embodiment of the embroidery sewing machine according to the present invention, in which the up-and-down table is located at the upward position.
Figure 24:
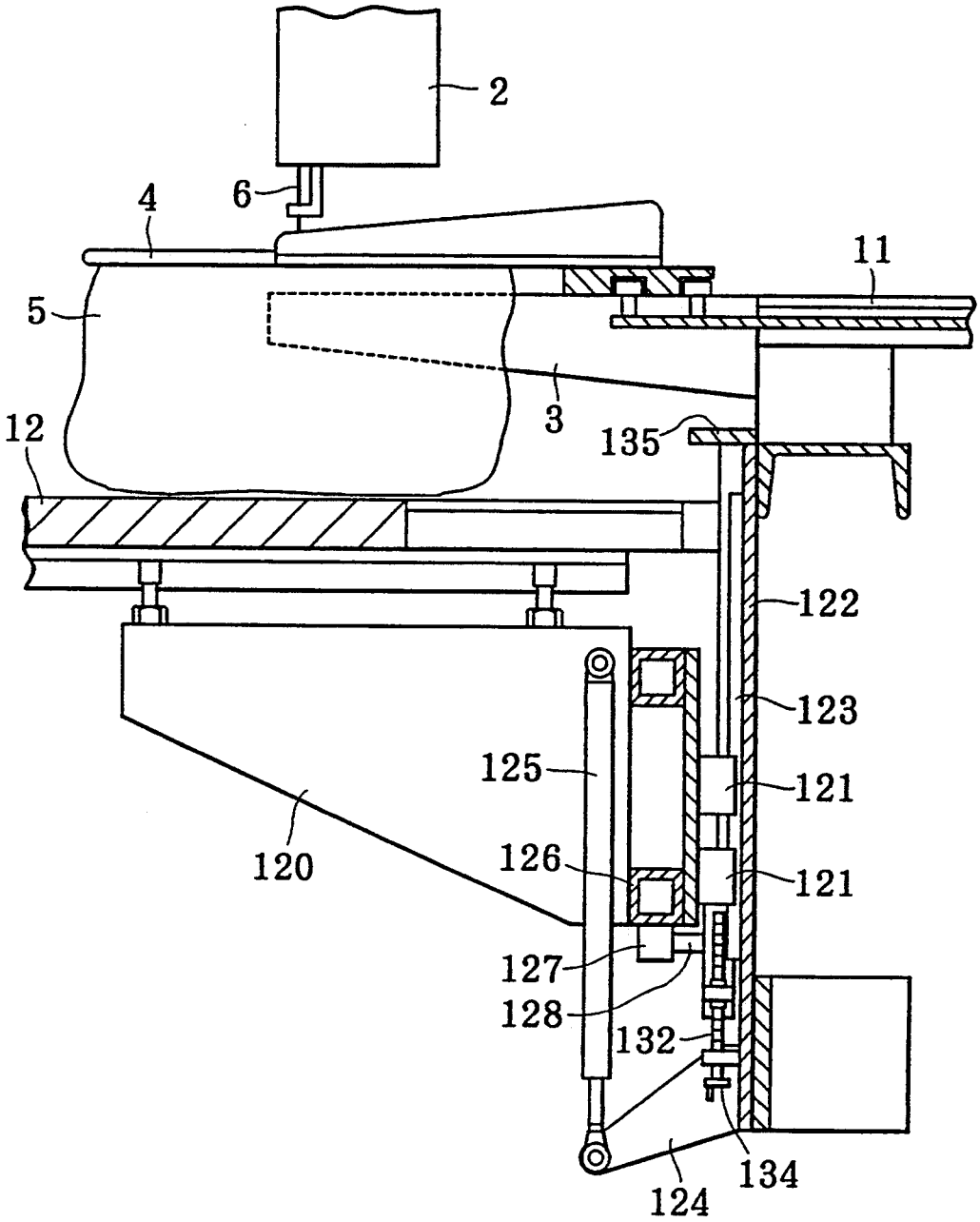
FIG. 24 is a cross-sectional view showing the seventh embodiment of the embroidery sewing machine according to the present invention, in which the up-and-down table is located at the downward position.
Figure 25:
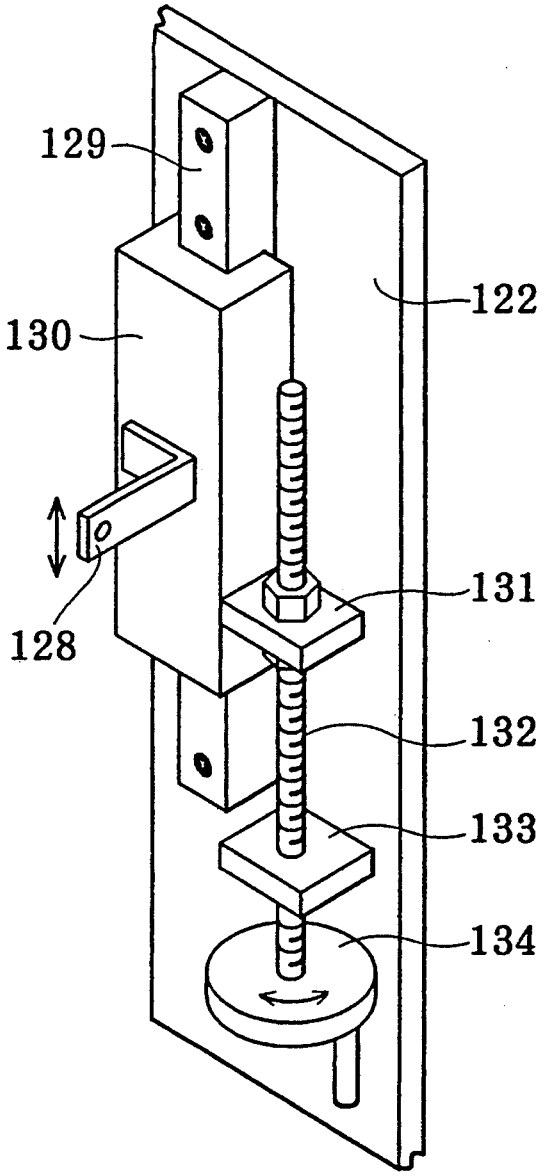
FIG. 25 is a perspective view showing the holding means of the seventh embodiment of the embroidery sewing machine according to the present invention.

A seventh embodiment of the present invention will be described with reference to FIGS. 23 to 25. This embodiment is different from the first embodiment in the supporting means, the holding means, and the auxiliary driving means of the up-and-down table 12. In more detail, this seventh embodiment comprises a pair of upper and lower slide bodies 121 attached to the back surface of a support frame 120 of the up-and-down table 12, and a vertical rail 123 fixed to an outer plate 122 of the leg portion of the machine frame 1 to guide the up-and-down motion of the two slide bodies 121.

The auxiliary driving means is a cylinder 125 whose upper end is connected to the support frame 120 and whose lower end is connected to a bracket 124 of the machine frame 1. Being actuated by hydraulic or gaseous pressure, the cylinder 125 applies an upward force to the up-and-down table 12 at all times. A stopper 135 fixed to the machine frame 1 limits the upward motion of the support frame 120 at the upward position of the up-and-down table 12, as shown in FIG. 23.

The holding means includes a fixing member 127 mounted on the table beam 126 of the support frame 120, and an engage body 128 vertically movably attached to the outer plate 122 of the leg portion of the machine frame 1 so as to be engaged with and disengaged from the fixing member 127. The engage body 128 is attached to a slide member 130, which is moved up and down along a rail 129 attached to the outer plate 122 of the leg portion. A vertically extending adjust screw rod 132 is rotatably attached to a bracket 131 formed so as to project from the slide member 130, without being moved in the vertical direction. The lower end of the adjust screw rod 132 is screwed into a bracket 133 attached to the outer plate 122 of the leg portion. Further, a rotary knob 134 is attached to the lower end of the adjust screw rod 132.

In this embodiment, it is possible to continuously adjust the downward position of the up-and-down table 12, by freely adjusting the vertical position of the engage body 128. The engage body 128 can be moved up and down by manually rotating the rotary knob 134 before or after lowering the up-and-down table 12. Therefore, it is possible to obtain the same effect as with the case of the first embodiment.

In the present invention, it is possible to appropriately modify the shape and the construction of the respective members or elements or to add additional functions within the scope not departing from the gist of the present invention as follows:

(1) Instead of the motor of the first embodiment, a pneumatic or hydraulic cylinder provided with a locking mechanism can be used. Instead of the driving means of the fourth embodiment, manual driving means such as a screw shaft can be adopted.

(2) To prevent an unexpected object from being caught between the up-and-down table and the cylindrical bed, the up-and-down table can be decelerated or stopped just before the upward end position (e.g. a position 5 cm lower than the upward end position). Further, a sensor for detecting an object to be caught therebetween can be provided for improvement of safety.

As many apparently widely different embodiments of this invention may be made without departing from the spirit and scope thereof, it is to be understood that the invention is not limited to the specific embodiments thereof except as defined in the appended claims.

What is claimed is:

1. An embroidery sewing machine, comprising:

a machine frame;

at least one cylindrical bed connected to said machine frame;

a fixed table;

at least one embroidery frame adapted to support a first portion of a cloth workpiece in a manner which permits said workpiece to be sewn;

a driving frame mounted on said fixed table for moving said at least one embroidery frame in one plane; and an up-and-down table disposed beneath said at least one embroidery frame and mounted for movement between an upward position roughly level with said cylindrical bed and at least two downward positions disposed beneath the upward position, said up-and-down table adapted to provide support to a second portion of said cloth workpiece which hangs below said embroidery frame and being provided separately from said fixed table so that said embroidery frame remains in said one plane as said up-and-down table is moved;

means for supporting said up-and-down table at different vertical positions including said upward position and said at least two downward positions; and means cooperable with said supporting means for selectively holding said up-and-down table at said upward position and said at least two downward positions.

2. An embroidery sewing machine according to claim 1, wherein said supporting means comprises at least one movable leg connected to said up-and-down table for up-and-down motion therewith and at least one fixed leg connected to the machine frame for guiding said up-and-down motion of said at least one movable leg.

3. An embroidery sewing machine according to claim 2, wherein an upper end of each said at least one movable leg is connected to said up-and-down table in a manner which balances said up-and-down table thereon.

4. An embroidery sewing machine according to claim 1, further comprising means for driving said up-and-down table vertically upwards and downwards.

5. An embroidery sewing machine according to claim 4, wherein said driving means comprises a rack provided for said movable leg, a pinion in mesh with said rack, a worm wheel rotatable together with said pinion, a worm in mesh with said worm wheel, and a manually operable handle for rotating said worm.

6. An embroidery sewing machine according to claim 1, wherein said holding means comprises a stationary worm.

7. An embroidery sewing machine according to claim 2, further comprising a clamp device for clamping said at least one movable leg to a corresponding one of said at least one fixed leg.

8. An embroidery sewing machine according to claim 3, wherein said upper end of one of said movable legs is connected to said up-and-down table generally at a center of gravity thereof.

9. An embroidery sewing machine according to claim 3, wherein said upper ends of at least two of said movable legs are connected to said up-and-down table at opposite sides of a center of gravity thereof in a manner which balances said up-and-down table thereon.

10. An embroidery sewing machine according to claim 1, wherein said at least one cylindrical bed comprises a plurality of cylindrical beds and wherein said at least one embroidery frame comprises a plurality of embroidery frames, said up-and-down table presenting a horizontal upwardly facing surface extending lengthwise beneath each of said cylindrical beds and embroidery frames to support respective workpieces hanging below each of said embroidery frames at one of said upward position and said at least two downward positions.

11. An embroidery sewing machine according to claim 4, wherein said driving means comprises a rack gear provided for said movable leg, a pinion gear in mesh with said rack gear, and a motor for rotating said pinion gear.

12. An embroidery sewing machine according to claim 11, wherein said holding means comprises a brake provided for said motor.

13. An embroidery sewing machine according to claim 1, wherein said up-and-down table further comprises a hinge on which a front end portion of said up-and-down table can be pivoted.

14. An embroidery sewing machine according to claim 1, wherein said at least one embroidery frame is movably disposed on said cylindrical bed, and further comprising an attachment movably disposed on said up-and-down table for supporting said embroidery frame from below.

15. An embroidery sewing machine according to claim 1, wherein said supporting means comprises a parallel crank mechanism for moving said up-and-down table in parallel motion.

16. An embroidery sewing machine according to claim 15, wherein said parallel crank mechanism comprises a coupling member fixed to said up-and-down table, a portion of said machine frame, and a pair of crank arms each having one end rotatably connected to said coupling member and the other end rotatably connected to said portion of said machine frame.

17. An embroidery sewing machine according to claim 16, further comprising means for auxiliary driving said up-and-down table.

18. An embroidery sewing machine according to claim 17, wherein said auxiliary driving means comprises an elastic member connected to at least one of said pair of crank arms and which applies an upward force to said up-and-down table at all times.

19. An embroidery sewing machine according to claim 17, wherein said auxiliary driving means comprises an elastic member connected to at least one of said pair of crank arms and which applies an upward force to said up-and-down table when said up-and-down table is disposed at said upward position and a downward force to said up-and-down table when said up-and-down table is disposed at one of said downward positions.

20. An embroidery sewing machine according to claim 15, wherein said holding means comprises a first engage member having a plurality of engage grooves disposed at different heights, and a second engage member provided with an engage projection engageable with and disengageable from one of the engage grooves of said first engage member.

21. An embroidery sewing machine according to claim 20, wherein said first engage member is mounted for pivotal movement and further comprises an elastic member for urging said first engage member in a manner which maintains said engage projection in engagement with said engage groove.

22. An embroidery sewing machine according to claim 20, wherein said second engage member is mounted for pivotal movement and further comprises a lock device for locking pivotal motion of said second engage member in a manner which maintains said engage projection in engagement with said engage groove.

23. An embroidery sewing machine according to claim 1, wherein said supporting means comprises a slide body mounted on a support frame of said up-and-down table, and a rail mounted on said machine frame to guide up-and-down motion of said slide body.

24. An embroidery sewing machine according to claim 23, further comprising means for auxiliarily driving said up-and-down table.

25. An embroidery sewing machine according to claim 24, wherein said auxiliary driving means comprises a cylinder connected to said up-and-down table and which applies an upward force to said up-and-down table at all times.

26. An embroidery sewing machine according to claim 23, wherein said holding means comprises a fixing member provided for a support frame and being of said up-and-down table, and an engage body provided for said machine frame vertically movably to be engaged with and disengaged from said fixing member.

* * * * *